US009315759B2

(12) United States Patent
Lange et al.

(10) Patent No.: US 9,315,759 B2
(45) Date of Patent: Apr. 19, 2016

(54) SYNERGISTIC MIXTURE

(75) Inventors: Arno Lange, Bad Duerkheim (DE); Dietmar Posselt, Heidelberg (DE)

(73) Assignee: BASF SE, Ludwigshafen (DE)

( * ) Notice: Subject to any disclaimer, the term of this patent is extended or adjusted under 35 U.S.C. 154(b) by 951 days.

(21) Appl. No.: 12/669,576

(22) PCT Filed: Jul. 10, 2008

(86) PCT No.: PCT/EP2008/058978

§ 371 (c)(1),
(2), (4) Date: Jan. 19, 2010

(87) PCT Pub. No.: WO2009/010441

PCT Pub. Date: Jan. 22, 2009

(65) Prior Publication Data

US 2010/0210492 A1 Aug. 19, 2010

(30) Foreign Application Priority Data

Jul. 16, 2007 (EP) ..... 07112530

(51) Int. Cl.

| | |
|---|---|
| ***C10M 133/48*** | (2006.01) |
| ***C10L 1/14*** | (2006.01) |
| ***C10L 1/233*** | (2006.01) |
| ***C10L 10/00*** | (2006.01) |
| ***C10L 10/04*** | (2006.01) |
| ***C10M 141/08*** | (2006.01) |
| ***C10M 163/00*** | (2006.01) |
| ***C10M 165/00*** | (2006.01) |
| *C10L 1/16* | (2006.01) |

(Continued)

(52) U.S. Cl.

CPC ..... *C10M 133/48* (2013.01); *C10L 1/14* (2013.01); *C10L 1/143* (2013.01); *C10L 1/233* (2013.01); *C10L 1/2335* (2013.01); *C10L 10/00* (2013.01); *C10L 10/04* (2013.01); *C10M 141/08* (2013.01); *C10M 163/00* (2013.01); *C10M 165/00* (2013.01); *C10L 1/1616* (2013.01); *C10L 1/1824* (2013.01); *C10L 1/1832* (2013.01); *C10L 1/2283* (2013.01); *C10L 1/232* (2013.01); *C10L 1/238* (2013.01); *C10L 1/24* (2013.01); *C10L 1/245* (2013.01); *C10L 1/2406* (2013.01); *C10L 1/2412* (2013.01); *C10L 1/2418* (2013.01); *C10L 1/2425* (2013.01); *C10L 1/2443* (2013.01); *C10L 1/2456* (2013.01); *C10L 1/2475* (2013.01); *C10L 1/265* (2013.01); *C10M 2215/042* (2013.01); *C10M 2215/225* (2013.01); *C10M 2217/043* (2013.01); *C10M 2219/022* (2013.01); *C10M 2219/06* (2013.01); *C10M 2219/062* (2013.01); *C10M 2219/082* (2013.01); *C10M 2219/083* (2013.01); *C10M 2219/084* (2013.01); *C10M 2219/086* (2013.01); *C10M 2219/09* (2013.01); *C10M 2219/102* (2013.01); *C10M 2219/104* (2013.01); *C10M 2221/041* (2013.01); *C10M 2223/045* (2013.01); *C10N 2230/08* (2013.01); *C10N 2230/10* (2013.01)

(58) Field of Classification Search

CPC ..... C10M 141/08; C10M 163/00; C10M 2221/041; C10M 2223/045; C10N 2230/08; C10N 2230/10; C10L 1/14; C10L 1/143; C10L 1/1616; C10L 1/1824; C10L 1/1832; C10L 1/2283; C10L 1/232; C10L 1/233; C10L 1/2335; C10L 1/238; C10L 1/24; C10L 1/2406; C10L 1/2412; C10L 1/2418; C10L 1/2425; C10L 1/2443; C10L 1/245; C10L 1/2456; C10L 1/2475; C10L 1/265; C10L 10/00; C10L 10/04

USPC ..... 508/251, 221, 551

See application file for complete search history.

(56) References Cited

U.S. PATENT DOCUMENTS

| | | | |
|---|---|---|---|
| 429,099 | A | 5/1890 | Salmon |
| 3,522,179 | A | 7/1970 | Le Suer |

(Continued)

FOREIGN PATENT DOCUMENTS

| | | |
|---|---|---|
| DE | 38 26 608 | 2/1990 |
| DE | 38 38 918 | 5/1990 |

(Continued)

OTHER PUBLICATIONS

U.S. Appl. No. 12/681,788, filed Apr. 6, 2010, Voelkel, et al.

(Continued)

*Primary Examiner* — James Goloboy

(74) *Attorney, Agent, or Firm* — Oblon, McClelland, Maier & Neustadt, L.L.P.

(57) ABSTRACT

A synergistic mixture comprising from 1 to 99.9% by weight of compounds having structural elements (I)

(I)

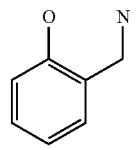

in which the free valencies on the oxygen atom and on the nitrogen atom may be combined to form a five-, six- or seven-membered ring and the benzene ring may also bear substituents at one or more of the free positions, and from 0.1 to 99% by weight of sulfur-containing organic compounds with antioxidant action. This synergistic mixture is suitable as a stabilizer for stabilizing inanimate organic material, especially mineral oil products and fuels, against the action of light, oxygen and heat.

17 Claims, No Drawings

(51) Int. Cl.

| | |
|---|---|
| *C10L 1/182* | (2006.01) |
| *C10L 1/183* | (2006.01) |
| *C10L 1/228* | (2006.01) |
| *C10L 1/232* | (2006.01) |
| *C10L 1/238* | (2006.01) |
| *C10L 1/24* | (2006.01) |
| *C10L 1/26* | (2006.01) |

(56) References Cited

U.S. PATENT DOCUMENTS

| | | | | |
|---|---|---|---|---|
| 4,234,435 | A | 11/1980 | Meinhardt et al. | |
| 4,402,840 | A | 9/1983 | DeVries et al. | |
| 4,849,572 | A | 7/1989 | Chen et al. | |
| 4,877,416 | A | 10/1989 | Campbell | |
| 4,904,401 | A | 2/1990 | Ripple et al. | |
| 4,946,610 | A * | 8/1990 | Lam et al. | 508/572 |
| 5,569,644 | A | 10/1996 | Geibach et al. | |
| 5,596,130 | A | 1/1997 | Wright et al. | |
| 5,725,611 | A | 3/1998 | Wright et al. | |
| 6,165,235 | A | 12/2000 | Kolp et al. | |
| 6,329,327 | B1 * | 12/2001 | Tanaka et al. | 508/362 |
| 7,988,749 | B2 * | 8/2011 | Lange et al. | 44/415 |
| 8,016,898 | B1 * | 9/2011 | Lange et al. | 44/415 |
| 2005/0153850 | A1 * | 7/2005 | Nelson et al. | 508/300 |
| 2008/0196300 | A1 * | 8/2008 | Lange et al. | 44/334 |
| 2009/0065744 | A1 * | 3/2009 | Lange et al. | 252/404 |

FOREIGN PATENT DOCUMENTS

| | | | |
|---|---|---|---|
| DE | 41 42 241 | | 6/1993 |
| DE | 43 09 074 | | 9/1994 |
| DE | 196 20 262 | | 11/1997 |
| DE | 19948111 | A1 * | 4/2001 |
| DE | 101 02 913 | | 7/2002 |
| EP | 0 307 815 | | 3/1989 |
| EP | 0 310 875 | | 4/1989 |
| EP | 0 356 725 | | 3/1990 |
| EP | 0 476 485 | | 3/1992 |
| EP | 0 548 617 | | 6/1993 |
| EP | 0 639 632 | | 2/1995 |
| EP | 0 452 328 | | 4/1995 |
| EP | 0 700 985 | | 3/1996 |
| EP | 0 831 141 | | 3/1998 |
| EP | 1 443 061 | | 8/2004 |
| WO | 87 01126 | | 2/1987 |
| WO | 94 24231 | | 10/1994 |
| WO | 96 03367 | | 2/1996 |
| WO | 96 03479 | | 2/1996 |
| WO | 97 03946 | | 2/1997 |
| WO | 00 47698 | | 8/2000 |
| WO | 01 25293 | | 4/2001 |
| WO | 01 25294 | | 4/2001 |
| WO | 02 077130 | | 10/2002 |
| WO | 03 038015 | | 5/2003 |
| WO | 03 106595 | | 12/2003 |
| WO | 2005 073152 | | 8/2005 |
| WO | 2007 012580 | | 2/2007 |
| WO | WO 2007012580 | A1 * | 2/2007 |
| WO | 2007 099048 | | 9/2007 |
| WO | WO 2007099048 | A2 * | 9/2007 |

OTHER PUBLICATIONS

U.S. Appl. No. 60/719,569, Sep. 23, 2005, Joseph, et al.
U.S. Appl. No. 12/527,970, filed Aug. 20, 2009, Posselt, et al.

* cited by examiner

SYNERGISTIC MIXTURE

CROSS REFERENCE TO RELATED APPLICATIONS

The present application is the national stage of international application PCT/EP2008/058978, filed on Jul. 10, 2008 , and claims the benefit of the filing date of European Application No. 07112530.6, filed on Jul. 16, 2007.

The present invention relates to a synergistic mixture of (A) at least one compound having a structural element of the formula (I)

(I)

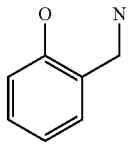

and (B) at least one sulfur-containing organic compound with antioxidant action. The present invention further relates to the use of this synergistic mixture as a stabilizer for stabilizing inanimate organic material against the action of light, oxygen and heat, especially in turbine fuels (jet fuels) and lubricant compositions. The present invention further relates to inanimate organic material, to a turbine fuel composition, to an additive concentrate for turbine fuels and to a lubricant composition which comprise this synergistic mixture.

The mechanical, chemical and/or esthetic properties of inanimate organic material, for example of plastics and coatings, but also of mineral oil products and fuels, are known to be worsened by the action of light, oxygen and heat. This worsening is shown typically as yellowing, discoloration, crack formation or embrittlement of the material. Stabilizers or stabilizer compositions with which improved protection against such an impairment of organic material by light, oxygen and heat can be achieved are already known.

For instance, WO 05/073152 (1) describes 2-alkylpolyisobutenylphenols and their Mannich adducts as antioxidants for stabilizing inanimate organic material against the action of light, oxygen and heat. The materials to be stabilized also include fuels such as gasoline fuels, diesel fuels and turbine fuels, and also lubricant compositions. In turbine fuels, these 2-alkylpolyisobutenylphenols and their Mannich adducts bring about an improvement in the thermal stability and a reduction in the deposits in the fuel circuit and combustion system of the turbines.

Tetrahydrobenzoxazines with a benzene ring and mixtures thereof with open-chain Mannich adducts are known as additives for fuel and lubricant compositions. For instance, WO 01/25293 (2) and WO 01/25294 (3) disclose open-chain Mannich adducts formed from polyisobutenyl-substituted phenols, formaldehyde and amines, and also tetrahydrobenzoxazines with relatively long-chain radicals such as polyisobutenyl radicals which are present as substituents on the benzene ring, as valve-cleaning gasoline fuel detergents which keep the valves clean. These tetrahydrobenzoxazines are obtained by the preparation process specified in (2) and (3) as mixtures with the corresponding open-chain Mannich adducts of the parent phenol and also used thus in the gasoline fuels.

WO 07/12580 (4) discloses the use of tetrahydrobenzoxazines as stabilizers, especially as antioxidants for protection against the action of light, oxygen and heat, for inanimate organic material, especially for mineral oil products and fuels such as turbine fuels.

WO 07/099,048 (5) likewise discloses the use of polycyclic phenolic compounds which have up to 20 benzene rings per molecule and are based on tetrahydrobenzoxazines as stabilizers, especially as antioxidants for protection against the action of light, oxygen and heat, for inanimate organic material, especially for mineral oil products and fuels such as turbine fuels.

There exists—especially for the mineral oil products and fuels sector—a need for compositions with improved protective action against the impairment of the material properties by light, oxygen and heat. For turbine fuels (jet fuels) in particular, which are subjected to extreme thermal stress in the course of and before the combustion process in turbines, for example in aircraft turbines, novel improved stabilizers are being sought. Circulating turbine fuel is part of the cooling system in turbine aircraft and can assume temperatures up to 220° C.; immediately before the actual combustion in the aircraft turbine, the turbine fuel reaches temperatures up to 595° C. The novel improved stabilizers should, in the turbines, simultaneously also reduce deposits in the fuel circuit and in the combustion system through their mode of action as antioxidants and/or dispersants. Moreover, novel improved stabilizers for lubricant compositions are being sought, which offer especially improved protection against oxidation and ageing behavior and/or improved shear stability.

It was therefore an object of the invention to provide stabilizers with improved stabilizing action on inanimate organic material, especially on mineral oil products and fuels, in particular on turbine fuel and on lubricant compositions, against the action of light, oxygen and heat.

Accordingly, a synergistic mixture has been found, which comprises (A) from 1 to 99.9% by weight of at least one compound having at least one structural element of the formula (I)

(I)

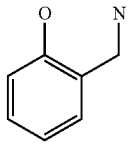

in which the free valencies on the oxygen atom and on the nitrogen atom may be combined to form a five-, six- or seven-membered ring, if necessary via a hydrocarbylene bridging member, and the benzene ring may also bear substituents at one or more of the free positions, and (B) from 0.1 to 99% by weight of at least one sulfur-containing organic compound with antioxidant action, where the sum of the two components (A) and (B) adds up to 100% by weight.

The free valence of the oxygen atom in the structural element (I) is preferably saturated by a hydrogen atom, such that a free phenolic structure is present. However, the free valence of the oxygen atom can, for example, also be saturated by an optionally substituted hydrocarbyl radical or an alkylcarbonyl radical. The two free valencies of the nitrogen atom in the structural element (I) are saturated typically by hydrogen and/or optionally substituted hydrocarbyl radicals.

The structural element (I) may be present as a benzofused five-, six- or seven-membered heterocyclic ring; in this case, the structural element (I) has, for example, the structure of a dihydrobenzisoxazole, of a tetrahydrobenzoxazine or of a tetrahydrobenz-1,4-oxazepine.

The inventive synergistic mixture may consist of only one component (A) and only one component (B) or of a plurality of components (A) and only one component (B) or of a plurality of components (A) and a plurality of components (B). The inventive synergistic mixture may be used alone or in a mixture with further compounds having stabilizer and/or antioxidant action.

The inventive mixture acts synergistically in the sense of the present invention because the desired action of the mixture is unexpectedly stronger than the sum of the individual actions of components (A) and (B).

The inventive synergistic mixture comprises preferably from 10 to 99% by weight, especially from 50 to 95% by weight, in particular from 65 to 90% by weight, of component (A) or of the sum of all components (A), and from 1 to 90% by weight, especially from 5 to 50% by weight, in particular from 10 to 35% by weight, of component (B) or of the sum of all components (B). When the inventive synergistic mixture is used with further compounds having stabilizer and/or antioxidant action, the proportion of the inventive synergistic mixture in the overall mixture of all compounds with stabilizer and/or antioxidant action is preferably at least 20% by weight, especially at least 50% by weight, in particular at least 70% by weight.

The compounds having at least one structural element of the formula (I) of components (A) are typically low molecular weight, oligomeric or polymeric organic compounds having a number-average molecular weight $M_n$ of generally not more than 100 000, especially not more than 50 000, in particular not more than 25 000.

In a preferred embodiment, the inventive synergistic mixture comprises, as component (A), at least one compound having at least one structural element of the formula (Ia) or (Ib)

(Ia)

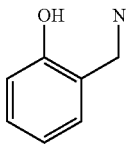

(Ib)

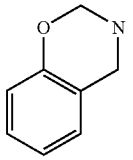

in which the benzene ring may also bear substituents at one or more of the free positions and the free valencies on the nitrogen atom are saturated as described above.

The ortho(aminomethyl)phenol structural element (Ia) of component (A) is typically generated by a Mannich reaction of a phenol or phenol derivative with formaldehyde and ammonia, a primary amine or a secondary amine. However, other preparation routes are also possible.

The tetrahydrobenzoxazine structural element (Ib) is formed typically by reaction of a phenol or phenol derivative with formaldehyde and ammonia, a primary amine or a secondary amine with use of at least twice the molar amount of formaldehyde needed in stoichiometric terms and under suitable reaction conditions. However, other preparation routes are also possible.

Particular preference is given to a synergistic mixture which comprises, as component (A), at least one compound having at least one structural element of the formula (I), (Ia) or (Ib), in which the nitrogen atom or the benzene ring bears at least one hydrocarbyl radical having at least 4, preferably having at least 13, having at least 16, having at least 20, having at least 21, having at least 23, having at least 25, having at least 26 or having at least 30 carbon atoms. Such a hydrocarbyl radical may, for example, be a polyisobutene radical.

In a particularly preferred embodiment, the inventive synergistic mixture comprises, as component (A), at least one Mannich reaction product of the general formula II (II)

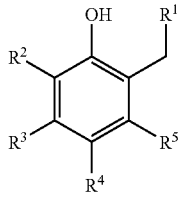

in which the substituent $R^1$ is the $NR^6R^7$ moiety in which $R^6$ and $R^7$ are each independently selected from hydrogen, $C_1$- to $C_{20}$-alkyl, $C_3$- to $C_8$-cycloalkyl, $C_6$- to $C_{14}$-aryl and $C_1$- to $C_{20}$-alkoxy radicals which may be interrupted by heteroatoms selected from nitrogen and oxygen and/or be substituted, and from phenol radicals of the formula III (III)

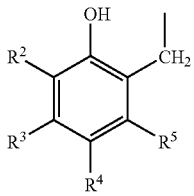

with the proviso that $R^6$ and $R^7$ are not both phenol radicals of the formula III, where $R^6$ and $R^7$, together with the nitrogen atom to which they are bonded, may also form a five-, six- or seven-membered ring which may have one or two heteroatoms selected from nitrogen and oxygen and/or may be substituted by one, two or three $C_1$- to $C_6$-alkyl radicals, where, moreover, the substituent $R^4$ in formula II and III is a terminally bound polyisobutene radical having from 13 to 3000, especially in particular from 20 to 2000, from 23 to 1150, carbon atoms, where, moreover, the substituents $R^2$, $R^3$ and $R^5$ in formula II and III are each independently hydrogen, $C_1$- to $C_{20}$-alkyl radicals, $C_1$- to $C_{20}$-alkoxy radicals, $C_2$- to $C_{4000}$-alkyl radicals which are interrupted by one or more oxygen atoms, sulfur atoms or $NR^8$ moieties, hydroxyl groups, polyalkenyl radicals or moieties of the formula $—CH_2NR^6R^7$ where $R^6$ and $R^7$ are each as defined above, and $R^6$ is hydrogen, $C_1$- to $C_6$-alkyl, $C_3$- to $C_8$-cycloalkyl or $C_6$- to $C_{14}$-aryl.

Such Mannich reaction products of the general formula II and their preparation are described, for example, in documents (1), (2) and (3), to which reference is made here explicitly.

The Mannich reaction products III mentioned are preferably prepared by reacting polyisobutene-substituted phenols obtainable by alkylating phenols with high-reactivity polyisobutenes either (i) with formaldehyde or oligomers or polymers of formaldehyde in the presence of a secondary amine or (ii) with an adduct of at least one amine to formaldehyde, another formaldehyde source or a formaldehyde equivalent. By the routes (i) and (ii) mentioned, preference is given to preparing those Mannich reaction products II in which $R^6$ and $R^7$ are not both hydrogen.

High-reactivity polyisobutenes shall be understood here to mean those which have a proportion of α- and β-vinylidene double bonds of at least 50 mol %, preferably of at least 60 mol %, especially of at least 80 mol %, in particular of at least 85 mol %, based on the polyisobutene macromolecules. These high-reactivity polyisobutenes normally have a number-average molecular weight of from 300 to 15 000 and a polydispersity of less than 3.0.

The phenols used as the starting material may be unsubstituted phenol or substituted phenols, especially ortho-alkyl-substituted phenols. Preference is given to monophenols; however, phenols having 2 or 3 hydroxyl groups on the benzene ring are also suitable in principle. The substituents which occur on the phenol ring may especially be $C_1$- to $C_{20}$-alkyl radicals, especially $C_1$- to $C_4$-alkyl radicals, $C_1$- to $C_{20}$-alkoxy radicals, especially $C_1$- to $C_4$-alkoxy radicals, or further polyalkenyl radicals, especially polyisobutene radicals of the type described above. Typical examples of such substituted phenols are 2-methylphenol, 2-ethylphenol and 2-tert-butylphenol.

The alkylation of the phenols with these high-reactivity polyisobutenes is undertaken preferably at a temperature below about 50° C. in the presence of a customary alkylation catalyst.

Formaldehyde sources suitable for the conversion to the Mannich reaction product according to route (i) or to the amine adduct according to route (ii) are formalin solution, formaldehyde oligomers such as trioxane, and formaldehyde polymers such as paraformaldehyde. Formalin solution and paraformaldehyde are particularly easy to handle. It is of course also possible to use gaseous formaldehyde.

Amines suitable for the conversion to the Mannich reaction product according to route (i) normally have a secondary amino function, no primary amino function and optionally one or more tertiary amino functions, since relatively large amounts of undesired oligomerization products can occur in the reaction with primary amines. Suitable amines for the formation of the amine adduct according to route (ii) are normally amines having at least one primary amine function or at least one secondary amine function.

Preferred radicals for the substituents $R^6$ and $R^7$ on the nitrogen atom are each independently hydrogen, $C_1$- to $C_8$-alkyl such as methyl, ethyl, n-propyl, isopropyl, n-butyl, sec-butyl, tert-butyl, n-pentyl, n-hexyl, n-heptyl, n-octyl or 2-ethylhexyl, $C_1$- to $C_4$-alkoxy such as methoxy or ethoxy, and also cyclohexyl and phenyl. The substituents $R^6$ and $R^7$ may together form a five-, six- or seven-membered saturated or partly unsaturated heterocyclic ring which, as well as the nitrogen atom from the $NR^6R^7$ moiety, may comprise further nitrogen and/or oxygen atoms; typical examples of such rings are piperidine, piperazine and morpholine.

Typical representatives of the Mannich reaction products of the general formula II are, according to the teaching of document (1), 2-aminomethyl-4-polyisobutyl-6-alkylphenols with the definitions for $R^6$=$R^7$ of hydrogen, methyl, β-hydroxyethyl, n-butyl, 2-ethylhexyl and phenyl, with a number-average molecular weight of the polyisobutyl radical of from 500 to 2300 and with the definitions for $R^2$ of methyl, isopropyl and tert-butyl (in each case preparable by alkylating 2-alkylphenol with polyisobutene and subsequent reaction with formaldehyde and ammonia or the corresponding amine).

Further typical representatives of the Mannich reaction products of the general formula II are, according to the teaching of documents (2) and (3), the Mannich reaction products formed from 4-polyisobutylphenols having a number-average molecular weight of the polyisobutyl radical of from 500 to 2300 with (route i) formaldehyde and morpholine, di[3-(dimethylamino)-n-propyl]amine, tetramethylmethylenediamine or dimethylamine or (route ii) with an adduct of formaldehyde and 3-(dimethylamino)-n-propylamine or tert-butylamine.

In a further particularly preferred embodiment, the inventive synergistic mixture comprises, as component (A), at least one tetrahydrobenzoxazine of the general formula IV (IV)

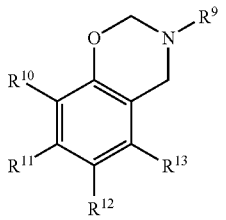

in which the substituent $R^9$ is a hydrocarbyl radical which has from 1 to 3000 carbon atoms and may be interrupted by one or more heteroatoms from the group of O and S and/or by one or more $NR^{14}$ moieties, where $R^{14}$ is a hydrogen atom or a $C_1$- to $C_4$-alkyl radical, and the substituents $R^{10}$, $R^{11}$, $R^{12}$ and $R^{13}$ are each independently hydrogen atoms, hydroxyl groups or hydrocarbyl radicals which have in each case from 1 to 3000 carbon atoms and may be interrupted by one or more heteroatoms from the group of O and S and/or by one or more $NR^{14}$ moieties, where $R^{14}$ is as defined above, where the substituent $R^{12}$ may also be a radical of the formula Y (Y)

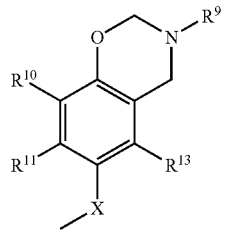

in which the substituents $R^9$, $R^{10}$, $R^{11}$ and $R^{13}$ are each as defined above and substituent X is a hydrocarbon bridging member which consists of one or more isobutene units or comprises one or more isobutene units, or where the substituent $R^{12}$ may also be a radical of the formula Z or Z'

(Z)

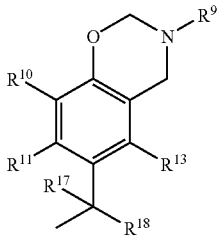

(Z')

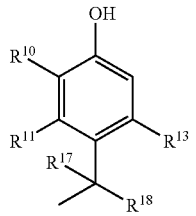

in which the substituents $R^9$, $R^{10}$, $R^{11}$ and $R^{13}$ are each as defined above and the substituents $R^{17}$ and $R^{18}$ may be the same or different and are each hydrogen or a $C_1$- to $C_{10}$-alkyl radical, and in which the substituents $R^{10}$ and $R^{11}$ or $R^{11}$ and $R^{12}$ or $R^{12}$ and $R^{13}$ may also form a second tetrahydrooxazine ring with the —O—$CH_2$—$NR^{15}$—$CH_2$— substructure attached to the benzene ring, or the substituents $R^{10}$ and $R^{11}$ and $R^{12}$ and $R^{13}$ may also form a second and a third tetrahydrooxazine ring with the —O—$CH_2$—$NR^{15}$—$CH_2$— and —O—$CH_2$—$NR^{16}$—$CH_2$— substructures attached to the benzene ring, where $R^{15}$ and $R^{16}$ are each independently hydrocarbyl radicals which have in each case from 1 to 3000 carbon atoms and may be interrupted by one or more heteroatoms from the group of O and S and/or by one or more $NR^{14}$ moieties, with the proviso that at least one of the substituents $R^9$, $R^{10}$, $R^{11}$, $R^{12}$, $R^{13}$, $R^{15}$ or $R^{16}$ has from 4 to 3000 carbon atoms and the remaining substituents from the group of $R^9$, $R^{10}$, $R^{11}$, $R^{12}$, $R^{13}$, $R^{15}$ and $R^{16}$, when they are hydrocarbyl radicals, each have from 1 to 20 carbon atoms.

Such tetrahydrobenzoxazines of the general formula IV and their preparation are described, for example, in document (4), to which reference is made here explicitly.

The structural peculiarity of the tetrahydrobenzoxazines of the general formula IV is that they comprise at least one relatively long-chain hydrocarbyl radical having from 4 to 3000 carbon atoms as one of the substituents $R^9$, $R^{10}$, $R^{11}$, $R^{12}$, $R^{13}$, $R^{15}$ or $R^{16}$ either on the benzene ring or on an oxazine ring. In a preferred embodiment, this relatively long-chain hydrocarbyl radical having from 4 to 3000 carbon atoms is a polyisobutenyl radical. The relatively long-chain hydrocarbyl radical mentioned may, in a further preferred embodiment, also be a $C_{16}$- to $C_{20}$-alkyl or -alkenyl radical. In particular, this relatively long-chain hydrocarbyl radical, which is preferably a polyisobutenyl radical or a $C_{16}$- to $C_{20}$-alkyl or -alkenyl radical, is present on an oxazine ring, i.e. it occurs as substituent $R^9$ or $R^{15}$ or $R^{16}$. This relatively long-chain hydrocarbyl radical, which is preferably a polyisobutenyl radical or a $C_{16}$- to $C_{20}$-alkyl or -alkenyl radical, is preferably also present on the benzene ring as substituent $R^{10}$ or $R^{12}$. This relatively long-chain hydrocarbyl radical, which is preferably a polyisobutenyl radical or a $C_{16}$- to $C_{20}$-alkyl or -alkenyl radical, comprises preferably from 16 to 3000, especially from 20 to 1000, in particular from 25 to 500, most preferably from 30 to 250 carbon atoms. In the case of polyisobutenyl radicals, they have number-average molecular weights $M_n$ of from 200 to 40 000, preferably from 500 to 15 000, especially from 700 to 7000, in particular from 900 to 3000, most preferably from 900 to 1100.

Suitable $C_{16}$- to $C_{20}$-alkyl or -alkenyl radicals are appropriately the radicals of corresponding saturated or unsaturated fatty alcohols having from 16 to 20 carbon atoms. Mention should be made here especially of n-hexadecyl (palmityl), n-octadecyl (stearyl), n-eicosyl, oleyl, linolyl and linolenyl, which usually occur as technical mixtures with one another according to their natural origin.

The said relatively long-chain hydrocarbyl radical having from 4 to 3000 carbon atoms may also be present more than once, for example twice or three times, in the tetrahydrobenzoxazines IV. This relatively long-chain hydrocarbyl radical, which is preferably a polyisobutenyl radical and/or a $C_{16}$- to $C_{20}$-alkyl or -alkenyl radical, occurs, for example, as substituent $R^9$ and $R^{12}$ or $R^9$ and $R^{15}$ when it occurs twice.

In a preferred embodiment, one or two polyisobutenyl radicals having a number-average molecular weight $M_n$ of from 200 to 40 000 occur in the molecule as substituent $R^9$ and/or $R^{10}$ and/or $R^{12}$ and/or $R^{15}$ and/or $R^{16}$.

The remaining substituents from the group of $R^9$, $R^{10}$, $R^{11}$, $R^{12}$, $R^{13}$, $R^{15}$ and $R^{16}$ which are not substituents having from 4 to 3000 carbon atoms or polyisobutenyl radicals having a number-average molecular weight $M_n$ of from 200 to 40 000 are each independently hydrogen atoms, hydroxyl groups or, when they are hydrocarbyl radicals, usually relatively short-chain hydrocarbyl radicals having from 1 to 20, preferably from 1 to 12, in particular from 1 to 8, carbon atoms most preferably linear or branched $C_1$- to $C_4$-alkyl radicals. Typical examples of the latter are methyl, ethyl, n-propyl, isopropyl, n-butyl, 2-butyl, sec-butyl and tert-butyl. Methyl radicals and tert-butyl radicals are very particularly preferred in this context.

Preferred tetrahydrobenzoxazines IV are also those in which the substituents $R^{10}$ and/or $R^{12}$, when they are relatively short-chain hydrocarbyl radicals, are linear or branched $C_1$- to $C_4$-alkyl radicals, especially methyl radicals and/or tert-butyl radicals. Such substitution patterns are of course possible only for tetrahydrobenzoxazines I having a total of one or two tetrahydrooxazine ring systems.

In the radical of the formula Y, the substituent X is a hydrocarbon bridging member which consists of one or more, preferably from 4 to 800, especially from 10 to 300, in particular from 12 to 100, isobutene units, or comprises one or more, preferably from 4 to 800, especially from 10 to 300, in particular from 12 to 100, isobutene units. Where X consists of isobutene units, the linkage is generally via the α- and the ω-carbon atom. When X comprises further hydrocarbon structural units, they are preferably initiator molecule structural units arranged internally, such as aromatic ring systems, for example o-, m- or p-phenylene units, and/or hydrocarbon structural units with functional groups for linkage, for example o-, m- or p-hydroxyphenyl groups, as the chain conclusion at both ends. Such telechelic polyisobutene systems which underlie the substituents X and their preparation are described, for example, in U.S. Pat. No. 4,429,099.

In the radical of the formula Z or Z', the substituents $R^{17}$ and $R^{18}$ are preferably each hydrogen and/or linear or branched $C_1$- to $C_4$-alkyl radicals, especially methyl radicals. The compound IV having a Z or Z' radical in which $R^{17}$=$R^{18}$=methyl derives from bisphenol A [2,2-bis(4-hydroxyphenyl)propane]. As a result of the preparation, compounds I with a Z radical and compounds I with the corresponding Z' radical may also be present as mixtures.

Hydrocarbyl radicals having from 1 to 3000 or from 4 to 3000 carbon atoms for the substituents $R^9$, $R^{10}$, $R^{11}$, $R^{12}$, $R^{13}$, $R^{15}$ and $R^{16}$ shall be understood here to mean pure hydrocarbon radicals of any structure which, by definition, may also be interrupted by one or more heteroatoms from the group of O and S and/or by one or more $NR^6$ moieties. In particular, hydrocarbyl radicals are alkyl, alkenyl, cycloalkyl, aryl, alkylaryl, alkenylaryl or arylalkyl radicals.

In the case of interruptions of the hydrocarbyl radical by $NR^{14}$ moieties, what are meant are also those radicals in which, at the end, the $NR^{14}$ moiety is inserted formally into a C—H bond, i.e., for example, substituents $R^9$, $R^{10}$, $R^{11}$, $R^{12}$, $R^{13}$, $R^{15}$ or $R^{16}$ with an $NH_2$ end group. Such hydrocarbyl radicals derive, for example, from polyamines such as ethylenediamine, diethylenetriamine, triethylenetetramine, tetraethylenepentamine, etc., in which one of the terminal nitrogen atoms is the nitrogen atom in the oxazine ring.

Examples of tetrahydrobenzoxazines IV which have a tetrahydrooxazine ring on the benzene ring and are typical in the context of the present invention are the following, where "PIB" denotes a polyisobutenyl radical derived from a high-reactivity polyisobutene ($M_n$ 1000) and "PIB*" a polyisobutenylene bridging member derived from a high-reactivity polyisobutene ($M_n$ 870):

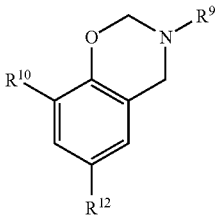

(Va) $R^9$ = methyl, $R^{10}$ = methyl, $R^{12}$ = PIB
(Vb) $R^9$ = methyl, $R^{10}$ = H, $R^{12}$ = PIB
(Vc) $R^9$ = methyl, $R^{10}$ = tert-butyl, $R^{12}$ = PIB
(Vd) $R^9$ = methyl, $R^{10}$ = OH, $R^{12}$ = PIB
(Ve) $R^9$ = methyl, $R^{10}$ = $R^{12}$ = tert-butyl
(Vf) $R^9$ = PIB, $R^{10}$ = tert-butyl, $R^{12}$ = methyl
(Vg) $R^9$ = methyl, $R^{10}$ = tert-butyl, $R^{12}$ = methyl

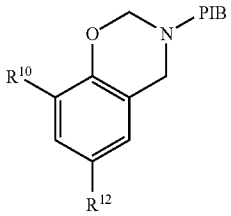

(VIa) $R^{10}$ = methyl, $R^{12}$ = methyl
(VIb) $R^{10}$ = H, $R^{12}$ = tert-butyl
(VIc) $R^{10}$ = methyl, $R^{12}$ = tert-butyl
(VId) $R^{10}$ = methyl, $R^{12}$ = OH
(VIe) $R^{10}$ =OH, $R^{12}$ = tert-butyl

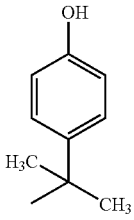

(VIf) $R^{10}$ = H, $R^{12}$ =

-continued

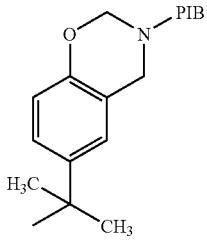

(VIg) $R^{10}$ = H, $R^{12}$ =

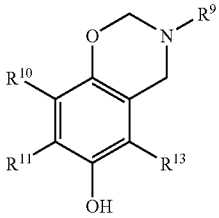

(VIIa) $R^9$ = n-hexyl, $R^{10}$ = $R^{11}$ = $R^{13}$ = methyl
(VIIb) $R^9$ = n-hexadecyl, $R^{10}$ = $R^{11}$ = $R^{13}$ = methyl
(VIIc) $R^9$ = n-octadecyl, $R^{10}$ = $R^{11}$ = $R^{13}$ = methyl
(VIId) $R^9$ = PIB, $R^{10}$ = $R^{11}$ = $R^{13}$ = methyl

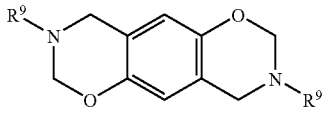

(VIIIa) $R^9$ = n-hexadecyl
(VIIIa) $R^9$ = n-octadecyl

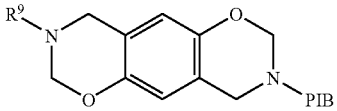

(IXa) $R^9$ = methyl
(IXb) $R^9$ = n-otcadecyl

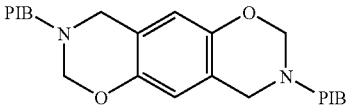

(X)

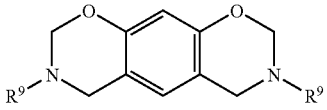

(XIa) $R^9$ = n-hexadecyl
(XIb) $R^9$ = n-octadecyl

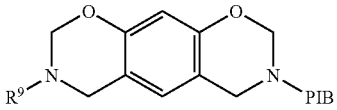

(XIIa) $R^9$ = methyl
(XIIb) $R^9$ = n-octadecyl

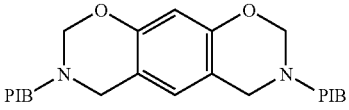

(XIII)

-continued

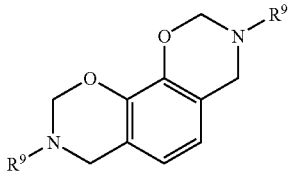

(XIVa) $R^9$ = n-hexadecyl
(XIVb) $R^9$ = n-octadecyl

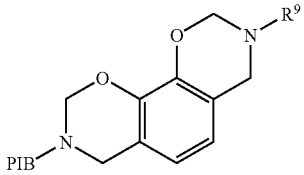

(XVa) $R^9$ = methyl
(XVb) $R^9$ = n-octadecyl

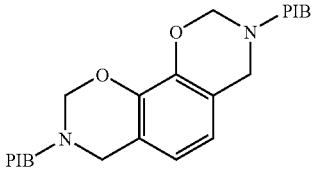

(XVI)

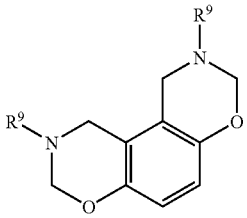

(XVIIa) $R^9$ = n-hexadecyl
(XVIIb) $R^1$ = n-octadecyl

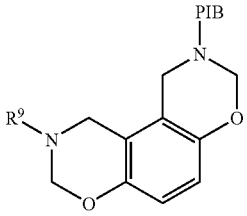

(XVIIIa) $R^9$ = methyl
(XVIIIb) $R^9$ = n-octadecyl

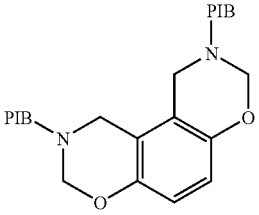

(XIX)

-continued

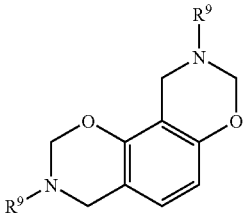

(XXa) $R^9$ = n-hexadecyl
(XXb) $R^9$ = n-octadecyl

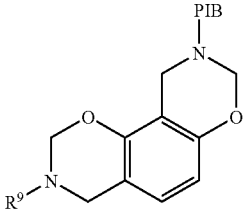

(XXIa) $R^9$ = methyl
(XXIb) $R^9$ = n-octadecyl

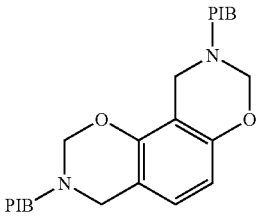

(XXII)

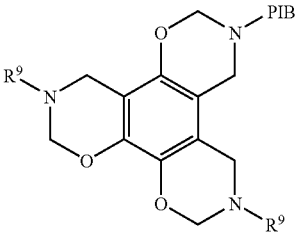

(XXIIIa) $R^9$ = methyl
(XXIIIb) $R^9$ = n-octadecyl

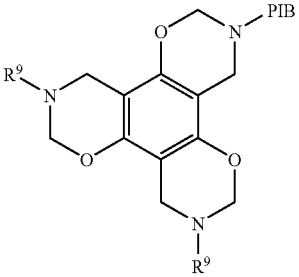

(XXIVa) $R^9$ = methyl
(XXIVb) $R^9$ = n-octadecyl

-continued

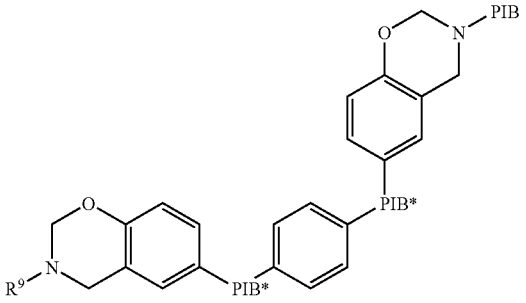

(XXVa) $R^9$ = methyl

As a result of the preparation, mixtures in each case of compounds VIIIa+XVIIa, VIIIb+XVIIb, IXa+XVIIIa, IXb+XVIIIb, X+XIX, XIa+XXa, XIb+XXb, XIIa+XXIa, XIIb+XXIb or XIII+XXII may also occur and be used in this form in accordance with the invention.

Preference is also given to using tetrahydrobenzoxazines IV in which the substituents $R^{11}$ and $R^{12}$ or $R^{12}$ and $R^{13}$ with an —O—$CH_2$—$NR^{15}$—$CH_2$— substructure oxygen-attached via substituent $R^{12}$ form a second tetrahydrooxazine ring. Examples thereof are the compounds VIII to XXII listed above.

It is also possible to use mixtures of Mannich reaction products of the general formula II and tetrahydrobenzoxazines of the general formula IV as component (A). Such mixtures resulting from the preparation are described, for example, in documents (2) and (3).

In a further particularly preferred embodiment, the inventive synergistic mixture comprises, as component (A), at least one polycyclic phenolic compound which has up to 20 benzene rings per molecule and is obtainable by reacting a tetrahydrobenzoxazine of the general formula XXVI (XXVI)

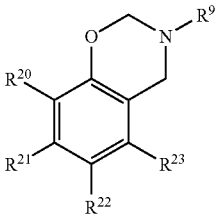

in which the substituent $R^{19}$ is a hydrocarbyl radical which has from 1 to 3000 carbon atoms and may be interrupted by one or more heteroatoms from the group of O and S and/or by one or more $NR^{24}$ moieties, where $R^{24}$ is a hydrogen atom or a $C_1$- to $C_4$-alkyl radical, and in which the substituents $R^{20}$, $R^{21}$, $R^{22}$ and $R^{23}$ are each independently hydrogen atoms, hydroxyl groups or hydrocarbyl radicals which have in each case from 1 to 3000 carbon atoms and may be interrupted by one or more heteroatoms from the group of O and S and/or by one or more $NR^{24}$ moieties where $R^{24}$ is as defined above, with one or more of the same or different phenols of the general formula XXVII (XXVII)

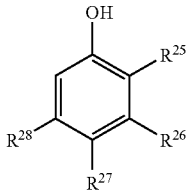

in which the substituents $R^{25}$, $R^{26}$, $R^{27}$ and $R^{28}$ are each independently hydrogen atoms, hydroxyl groups or hydrocarbyl radicals which have in each case from 1 to 3000 carbon atoms and may be interrupted by one or more heteroatoms from the group of O and S and/or by one or more $NR^{24}$ moieties where $R^{24}$ is as defined above, and/or with one or more of the same or different tetrahydrobenzoxazines of the general formula XXVI, where the substituent $R^{22}$ may also be a radical of the formula Z" and the substituent $R^{27}$ may also be a radical of the formula Z'''

(Z")

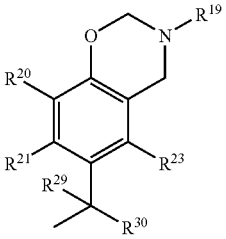

(Z''')

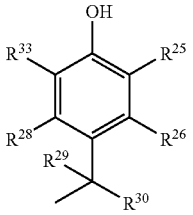

in which the substituents $R^{19}$, $R^{20}$, $R^{21}$, $R^{23}$, $R^{25}$, $R^{26}$ and $R^{28}$ are each as defined above, the substituent $R^{25}$ may also be a radical derived from a tetrahydrobenzoxazine of the general formula XXVI, the substituent $R^{33}$ is hydrogen or a radical derived from a tetrahydrobenzoxazine of the general formula XXVI, and the substituents $R^{29}$ and $R^{30}$ may be the same or different and are each hydrogen or a $C_1$- to $C_{10}$-alkyl radical, and in which the substituents $R^{20}$ and $R^{21}$ or $R^{21}$ and $R^{22}$ or $R^{22}$ and $R^{23}$ may also form a second tetrahydrooxazine ring with the —O—$CH_2$—$NR^{31}$—$CH_2$— substructure attached to the benzene ring, or the substituents $R^{20}$ and $R^{21}$ and $R^{22}$ and $R^{23}$ may also form a second and a third tetrahydrooxazine ring with the —O—$CH_2$—$NR^{31}$—$CH_2$— and —O—$CH_2$—$NR^{32}$—$CH_2$— substructures attached to the benzene ring, where $R^{31}$ and $R^{32}$ are each independently hydrocarbyl radicals which have in each case from 1 to 3000 carbon atoms and maybe interrupted by one or more heteroatoms from the group of O and S and/or by one or more $NR^{24}$ moieties where $R^{24}$ is as defined above, with the proviso that at least one of the substituents $R^{19}$, $R^{20}$, $R^{21}$, $R^{22}$, $R^{23}$, $R^{25}$, $R^{26}$, $R^{27}$, $R^{28}$, $R^{31}$ or $R^{32}$ has from 13 to 3000 carbon atoms and the remaining substituents from the group of $R^{19}$, $R^{20}$, $R^{21}$, $R^{22}$, $R^{23}$, $R^{25}$, $R^{26}$, $R^{27}$, $R^{28}$, $R^{31}$ or $R^{32}$, when they are hydrocarbyl radicals, have in each case from 1 to 20 carbon atoms.

Such polycyclic phenolic compounds having up to 20 benzene rings per molecule and their preparation are described, for example, in document (5), to which reference is made here explicitly.

The structural peculiarity of the polycyclic phenolic compounds mentioned is that they comprise at least one relatively long-chain hydrocarbyl radical having from 13 to 3000 carbon atoms as one of the substituents $R^{19}$, $R^{20}$, $R^{21}$, $R^{22}$, $R^{23}$, $R^{25}$, $R^{26}$, $R^{27}$, $R^{28}$, $R^{31}$ or $R^{32}$, which stem from the tetrahydrobenzoxazines XXVI or the phenols XXVII used. In a preferred embodiment, this relatively long-chain hydrocarbyl radical having from 13 to 3000 carbon atoms is a polyisobutenyl radical. In a further embodiment, the relatively long-chain hydrocarbyl radical mentioned may also be a $C_{16}$- to $C_{20}$-alkyl or -alkenyl radical. In particular, this relatively long-chain hydrocarbyl radical, which is preferably a polyisobutenyl radical, is present on an oxazine ring or on a benzene ring in the ortho position or preferably in the para position to the phenolic hydroxyl group, i.e. it occurs as substituent $R^{19}$ or $R^{20}$ or $R^{22}$ or $R^{25}$ or $R^{27}$ or $R^{31}$ or $R^{32}$. This relatively long-chain hydrocarbyl radical, which is preferably a polyisobutenyl radical, comprises preferably from 21 to 3000 or preferably from 21 to 1000, especially from 26 to 3000 or especially from 26 to 500, in particular from 30 to 3000 or in particular from 30 to 250 carbon atoms. In the case of polyisobutenyl radicals, they have number-average molecular weights $M_n$ of from 183 to 42 000, preferably from 500 to 15 000, especially from 700 to 7000, in particular from 900 to 3000, most preferably from 900 to 1100.

Suitable 016- to $C_{20}$-alkyl or -alkenyl radicals are appropriately the radicals of corresponding saturated or unsaturated fatty alcohols having from 16 to 20 carbon atoms. Mention should be made here especially of n-hexadecyl (palmityl), n-octadecyl (stearyl), n-eicosyl, oleyl, linolyl and linolenyl, which usually occur as technical mixtures with one another according to their natural origin.

The said relatively long-chain hydrocarbyl radical having from 13 to 3000 carbon atoms may also be present more than once, for example twice or three times, in the polycyclic phenolic compounds mentioned. In a preferred embodiment, one or two polyisobutenyl radicals having a respective number-average molecular weight $M_n$ of from 183 to 42 000 occur in the molecule as substituent $R^{19}$ and/or $R^{20}$ and/or $R^{22}$ and/or $R^{25}$ and/or $R^{27}$ and/or $R^{31}$ and/or $R^{32}$.

The remaining substituents from the group of $R^{19}$, $R^{20}$, $R^{21}$, $R^{22}$, $R^{23}$, $R^{25}$, $R^{26}$, $R^{27}$, $R^{28}$, $R^{31}$ or $R^{32}$ which are not substituents having from 13 to 3000 carbon atoms or polyisobutenyl radicals having a number-average molecular weight $M_n$, of from 183 to 42 000 are each independently hydrogen atoms, hydroxyl groups or, when they are hydrocarbyl radicals, usually relatively short-chain hydrocarbyl radicals having from 1 to 20, preferably from 1 to 12, in particular from 1 to 8, carbon atoms most preferably linear or branched $C_1$- to $C_4$-alkyl radicals. Typical examples of the latter are methyl, ethyl, n-propyl, isopropyl, n-butyl, 2-butyl, sec-butyl and tert-butyl. Methyl radicals and tert-butyl radicals are very particularly preferred in this context.

Preferred phenolic compounds are also those in which the substituents $R^{20}$ and/or $R^{22}$ and/or $R^{25}$ and/or $R^{27}$ which stem from the tetrahydrobenzoxazines XXVI or phenols XXVII used, when they are relatively short-chain hydrocarbyl radicals, are linear or branched $C_1$- to $C_4$-alkyl radicals, especially methyl radicals and/or tert-butyl radicals. Such substitution patterns are of course possible only in tetrahydrobenzoxazines XXVI having a total of one or two tetrahydrooxazine ring systems.

In the radical of the formula Z" or Z"', the substituents $R^{29}$ and $R^{30}$ are preferably each hydrogen and/or linear or branched $C_1$- to $C_4$-alkyl radicals, especially methyl radicals. The compounds XXVI and XXVII having a Z" or Z"' radical in which $R^{29}$=$R^{30}$=methyl derive from bisphenol A [2,2-bis (4-hydroxyphenyl)propane]. As a result of the preparation, compounds XXVI having a Z" radical and compounds XXVI having the corresponding Z"' radical may also be present as mixtures.

Hydrocarbyl radicals having from 1 to 3000 or from 13 to 3000 carbon atoms for the substituents $R^{19}$, $R^{20}$, $R^{21}$, $R^{22}$, $R^{23}$, $R^{25}$, $R^{26}$, $R^{27}$, $R^{28}$, $R^{31}$ and $R^{32}$ shall be understood here to mean pure hydrocarbon radicals of any structure which, by definition, may also be interrupted by one or more heteroatoms from the group of O and S and/or by one or more $NR^{24}$ moieties. A typical hydrocarbyl radical interrupted by an $NR^6$ moiety derives from 3-(dimethylamino)propylamine. In particular, hydrocarbyl radicals are alkyl, alkenyl, cycloalkyl, aryl, alkylaryl, alkenylaryl or arylalkyl radicals.

In the case of interruptions of the hydrocarbyl radical by $NR^{24}$ moieties, what are meant are also those radicals in which, at the end, the $NR^{24}$ moiety is inserted formally into a C—H bond, i.e., for example, substituents $R^{19}$, $R^{20}$, $R^{21}$, $R^{22}$, $R^{23}$, $R^{25}$, $R^{26}$, $R^{27}$, $R^{28}$, $R^{31}$ or $R^{32}$ with an $NH_2$ end group. Such hydrocarbyl radicals derive, for example, from polyamines such as ethylenediamine, diethylenetriamine, triethylenetetramine, tetraethylenepentamine, etc., in which one of the terminal nitrogen atoms is the nitrogen atom in the oxazine ring.

For the aforementioned compounds, the expression "alkyl" comprises straight-chain and branched alkyl groups. Examples of alkyl groups, as well as those already mentioned above, are methyl, ethyl, n-propyl, isopropyl, n-butyl, 2-butyl, sec-butyl and tert-butyl radicals, especially also n-pentyl, 2-pentyl, 2-methylbutyl, 3-methylbutyl, 1,2-dimethylpropyl, 1,1-dimethylpropyl, 2,2-dimethylpropyl, 1-ethylpropyl, n-hexyl, 2-hexyl, 2-methylpentyl, 3-methylpentyl, 4-methylpentyl, 1,2-dimethylbutyl, 1,3-dimethylbutyl, 2,3-dimethylbutyl, 1,1-dimethylbutyl, 2,2-dimethylbutyl, 3,3-dimethylbutyl, 1,1,2-trimethylpropyl, 1,2,2-trimethylpropyl, 1-ethylbutyl, 2-ethylbutyl, 1-ethyl-2-methylpropyl, n-heptyl, 2-heptyl, 3-heptyl, 2-ethylpentyl, 1-propylbutyl, n-octyl, 2-ethylhexyl, 2-propylheptyl, n-nonyl, n-decyl, n-dodecyl, n-tridecyl, isotridecyl, n-tetradecyl (myristyl), n-hexadecyl (palmityl), n-octadecyl (stearyl) and n-eicosyl.

Examples of alkenyl radicals for the aforementioned compounds are vinyl, 1-propenyl, 2-propenyl, oleyl, linolyl and linolenyl.

Examples of cycloalkyl radicals for the aforementioned compounds are $C_5$- to $C_7$-cycloalkyl groups such as cyclopentyl, cyclohexyl and cycloheptyl, which may also be substituted by alkyl groups, for example methyl radicals.

The expression "aryl" for the aforementioned compounds comprises monocyclic, bicyclic, tricyclic and higher polycyclic aromatic hydrocarbon radicals. In the case of substitution by the alkyl and/or alkenyl radicals mentioned above by way of example to give alkylaryl or alkenylaryl radicals, these aryl radicals may also bear 1, 2, 3, 4 or 5, preferably 1, 2 or 3, substituents. Typical examples are phenyl, tolyl, xylyl, mesityl, naphthyl, fluorenyl, anthracenyl, phenanthrenyl, naphthacenyl and styryl. A typical example of an arylalkyl radical is benzyl.

When the relatively long-chain hydrocarbyl radical having from 4 to 3000 or having from 13 to 3000 carbon atoms is a polyisobutenyl radical, it may in principle be based on any common and commercially available polyisobutene which is introduced in a suitable manner into the synthesis of the tetrahydrobenzoxazines IV or of the polycyclic phenolic compounds mentioned. Such a polyisobutene has a number-average molecular weight $M_n$ of at least 183 or 200. Preference is given to polyisobutenes having a number-average molecular weight $M_n$ in the range from 200 to 40 000 or from 183 to 42 000, more preferably from 500 to 15 000, in particular from 700 to 7000, especially from 800 to 500, specifically from 900 to 3000 and most preferably from 900 to 1100. In the context of the present invention, the term "polyisobutene" also includes oligomeric isobutenes such as dimeric, trimeric, tetrameric, pentameric, hexameric and heptameric isobutene.

The polyisobutenyl radicals incorporated into the aforementioned compounds preferably derive from so-called "reactive" polyisobutene. "High-reactivity" polyisobutenes differ from the "low-reactivity" polyisobutenes by the content of terminal double bonds. For instance, high-reactivity polyisobutenes comprise at least 50 mol % of terminal double bonds based on the total number of polyisobutene macromolecules. Particular preference is given to polyisobutenes having at least 60 mol %, especially having at least 80 mol %, in particular having at least 85 mol % of terminal double bonds based on the total number of polyisobutene macromolecules. The terminal double bonds may be either vinyl double bonds [—CH═C$(CH_3)_2$] (β-olefin) or vinylidene double bonds [—CH—C(═$CH_2$)—$CH_3$] (α-olefin). Moreover, the essentially homopolymeric polyisobutenyl radicals have uniform polymer skeletons. In the context of the present invention, this is understood to mean those polyisobutene systems which are formed from isobutene units of the repeat unit [—$CH_2$C$(CH_3)_2$—] to an extent of at least 85% by weight, preferably to an extent of at least 90% by weight and more preferably to an extent of at least 95% by weight.

A further preferred feature of the polyisobutenes on which the tetrahydrobenzoxazines IV or the polycyclic phenolic compounds mentioned may be based is that they are terminated by a tert-butyl group [—$CH_2$C$(CH_3)_3$] to an extent of at least 15% by weight, especially to an extent of at least 50% by weight, in particular to an extent of at least 80% by weight.

Moreover, the polyisobutenes which preferably serve as the basis for the tetrahydrobenzoxazines XXVI or phenols XXVII used as the starting material for the tetrahydrobenzoxazines IV or the polycyclic phenolic compounds mentioned preferably have a polydispersity index (PDI) of from 1.05 to 10, preferably from 1.05 to 3.0, especially from 1.05 to 2.0. Polydispersity is understood to mean the quotient of weight-average molecular weight $M_w$ and number-average molecular weight $M_n$ (PDI=$M_w/M_n$). In a preferred embodiment, the average polydispersity index PDI for the polyisobutenyl radicals in the polycyclic phenolic compounds mentioned is at most 5 times, preferably at most 3 times, especially at most 2 times, in particular at most 1.5 times, the average polydispersity index PDI for the polyisobutenyl radicals in the parent tetrahydrobenzoxazines XXVI and/or phenols XXVII.

In the context of the present invention, the polyisobutenes which preferably serve as the basis of the aforementioned compounds are also understood to mean all polymers which are obtainable by cationic polymerization and comprise, in copolymerized form, preferably at least 60% by weight of isobutene, more preferably at least 80% by weight, in particular at least 90% by weight and especially at least 95% by weight of isobutene. In addition, the polyisobutenes may comprise, in copolymerized form, further butene isomers such as 1- or 2-butene and different olefinically unsaturated monomers which are copolymerizable with isobutene under cationic polymerization conditions.

Suitable isobutene feedstocks for the preparation of polyisobutenes which may serve as the basis of the tetrahydrobenzoxazines IV and the polycyclic phenolic compounds mentioned are accordingly both isobutene itself and isobutenic $C_4$ hydrocarbon streams, for example $C_4$ raffinates, $C_4$ cuts from isobutene dehydrogenation, $C_4$ cuts from steam crackers, FCC crackers (FCC: Fluid Catalyzed Cracking), provided that they have been substantially freed of 1,3-butadiene present therein. Particularly suitable $C_4$ hydrocarbon streams comprise generally less than 500 ppm, preferably less than 200 ppm, of butadiene. When $C_4$ cuts are used as the starting material, the hydrocarbons other than isobutene assume the role of an inert solvent.

Useful monomers copolymerizable with isobutene include vinylaromatics such as styrene and α-methylstyrene, $C_1$-$C_4$-alkylstyrenes such as 2-, 3- and 4-methylstyrene, and also 4-tert-butylstyrene, isoolefins having from 5 to 10 carbon atoms, such as 2-methylbutene-1,2-methylpentene-1,2-methylhexene-1,2-ethylpentene-1,2-ethylhexene-1 and 2-propylheptene-1.

Typical polyisobutenes which may serve as the basis of the aforementioned compounds are, for example, the Glissopal® brands of BASF Aktiengesellschaft, e.g. Glissopal 550, Glissopal 1000 and Glissopal 2300, and the Oppanol® brands of BASF Aktiengesellschaft, e.g. Oppanol B10, B12 and B15.

In addition to polyisobutenyl radicals, the relatively long-chain hydrocarbyl radicals which occur for the tetrahydrobenzoxazine IV or the polycyclic phenolic compounds mentioned may also be those which derive from oligomers or polymers of $C_2$- to $C_{12}$-olefins and have an average of from 13 to 3000 carbon atoms. Such usually polydisperse hydrocarbyl radicals with polymeric distribution are, for example, those which derive from ethylene, propylene, butene, styrene, methylstyrene, hexene-1, octene-1, decene-1 or dodecene-1. They may be homopolymer or copolymer radicals. Their number-average molecular weight $M_n$ is at least 183, their polydispersity index PDI typically from 1.05 to 10. In the case of low molecular weight radicals with $M_n$, of from 183 to approx. 500, they may also be present in monodisperse form.

In a preferred embodiment, the polycyclic phenolic compounds mentioned have a mean molecular weight $M_n$ of from 411 to 25 000. For example, the molecular weight $M_n$ of 411 represents the smallest representative of the polycyclic phenolic compounds in the context of the present invention, specifically bis(ortho- or para-hydroxybenzyl)tridecylamine. Particularly preferred ranges for $M_n$ are from 523 to 25 000 or from 523 to 17 000, especially from 593 to 25 000 or from 593 to 10 000, in particular from 649 to 25 000 or from 649 to 5000.

Examples of polycyclic phenolic compounds typical in the context of the present invention are the following, where "PIB" denotes a polyisobutenyl radical derived from a high-reactivity polyisobutene ($M_n$ 1000):

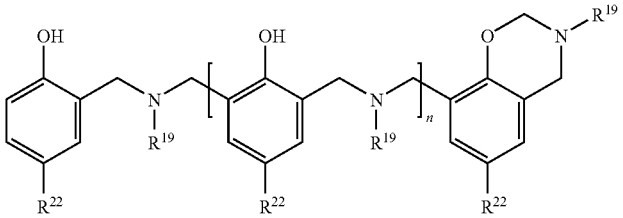

(XXVIIIa) n = 0, $R^{19}$ = PIB, $R^{22}$ = H
(XXVIIIb) n = 0, $R^{19}$ = methyl, $R^{22}$ = PIB
(XXVIIIc) n = 0, $R^{19}$ = PIB, $R^{22}$ = tert-butyl (XXVIIId) n = 1, $R^{19}$ = PIB, $R^{22}$ = H
(XXVIIIe) n = 1, $R^{19}$ = methyl, $R^{22}$ = PIB
(XXVIIIf) n = 1, $R^{19}$ = PIB, $R^{22}$ = tert-butyl (XXVIIIg) n = 2, $R^{19}$ = PIB, $R^{22}$ = H
(XXVIIIh) n = 2, $R^{19}$ = methyl, $R^{22}$ = PIB
(XXVIIIi) n = 2, $R^{19}$ = PIB, $R^{22}$ = tert-butyl (XXVIIIj) n = 3, $R^{19}$ = PIB, $R^{22}$ = H
(XXVIIIk) n = 3, $R^{19}$ = methyl, $R^{22}$ = PIB
(XXVIIIl) n = 3, $R^{19}$ = PIB, $R^{22}$ = tert-butyl (XXVIIIm) n = 4, $R^{19}$ = PIB, $R^{22}$ = H
(XXVIIIn) n = 4, $R^{19}$ = methyl, $R^{22}$ = PIB
(XXVIIIo) n = 4, $R^{19}$ = PIB, $R^{22}$ = tert-butyl (XXVIIIp) n = 5, $R^{19}$ = PIB, $R^{22}$ = H
(XXVIIIq) n = 5, $R^{19}$ = methyl, $R^{22}$ = PIB
(XXVIIIr) n = 5, $R^{19}$ = PIB, $R^{22}$ = tert-butyl (XXVIIIs) n = 6, $R^{19}$ = PIB, $R^{22}$ = H
(XXVIIIt) n = 6, $R^{19}$ = methyl, $R^{22}$ = PIB
(XXVIIIu) n = 6, $R^{19}$ = PIB, $R^{22}$ = tert-butyl (XXVIIIv) n = 1, $R^{19}$ = methyl,
1 $R^{22}$ radical = PIB, 2 $R^{22}$ radicals = tert-butyl
(XXVIIIw) n = 8, $R^{19}$ = methyl,
1 $R^{22}$ radical = PIB, 9 $R^{22}$ radicals = tert-butyl

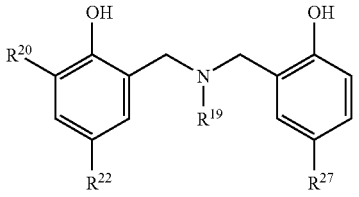

(XXIXa) $R^{19}$ = methyl, $R^{20}$ = H, $R^{22}$ = tert-butyl, $R^{27}$ = PIB
(XXIXb) $R^{19}$ = methyl, $R^{20}$ = $R^{22}$ = tert-butyl, $R^{27}$ = PIB
(XXIXc) $R^{19}$ = PIB, $R^{20}$ = $R^{22}$ = tert-butyl, $R^{27}$ = H
(XXIXd) $R^{19}$ = PIB, $R^{20}$ = $R^{22}$ = $R^{27}$ = H
(XXIXe) $R^{19}$ = PIB, $R^{20}$ = $R^{22}$ = H, $R^{27}$ = tert-butyl
(XXIXf) $R^{19}$ = PIB, $R^{20}$ = H, $R^{22}$ = tert-butyl, $R^{27}$ = PIB
(XXIXg) $R^{19}$ = PIB, $R^{20}$ = $R^{22}$ = tert-butyl, $R^{27}$ = PIB

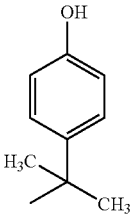

(XXIXh) $R^{19}$ = PIB, $R^{20}$ = $R^{22}$ = H, $R^{27}$ =

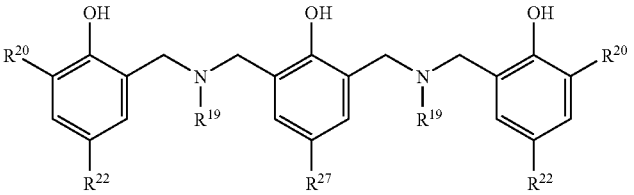

(XXXa) $R^{19}$ = methyl, $R^{20}$ = $R^{22}$ = H, $R^{27}$ = PIB
(XXXb) $R^{19}$ = methyl, $R^{20}$ = $R^{22}$ = tert-butyl, $R^{27}$ = PIB
(XXXc) $R^{19}$ = methyl, $R^{20}$ = tert-butyl, $R^{22}$ = methyl, $R^{27}$ = PIB
(XXXd) $R^{19}$ = $R^{20}$ = methyl, $R^{22}$ = tert-butyl, $R^{27}$ = PIB
(XXXe) $R^{19}$ = 3-(dimethylamino)propyl, $R^{20}$ = $R^{22}$ = tert-butyl, $R^{27}$ = PIB
(XXXf) $R^{19}$ = PIB, $R^{20}$ = $R^{22}$ = $R^{27}$ = H
(XXXg) $R^{19}$ = PIB, $R^{20}$ = $R^{22}$ = H, $R^{27}$ = tert-butyl
(XXXh) $R^{19}$ = PIB, $R^{20}$ = $R^{22}$ = tert-butyl, $R^{27}$ = H
(XXXi) $R^{19}$ = PIB, $R^{20}$ = H, $R^{22}$ = $R^{27}$ = tert-butyl
(XXXj) $R^{19}$ = PIB, $R^{20}$ = $R^{22}$ = $R^{27}$ = tert-butyl
(XXXk) $R^{19}$ = PIB, $R^{20}$ = $R^{22}$ =H, $R^{27}$ = PIB -continued

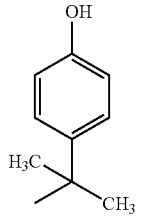

(XXXm) $R^{19}$ = PIB, $R^{20}$ = $R^{22}$ = H, $R^{22}$ =

(XXXn) $R^{19}$ = 3-(dimethylamino)propyl, $R^{20}$ = tert-butyl, $R^{22}$ = methyl, $R^{27}$ = PIB

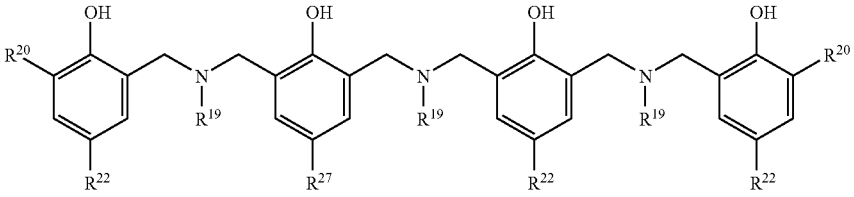

(XXXIa) $R^{19}$ = methyl, $R^{20}$ = $R^{22}$ = H, $R^{27}$ = PIB (XXXIb) $R^{19}$ = methyl, $R^{20}$ = $R^{22}$ = tert-butyl, $R^{27}$ = PIB (XXXIc) $R^{19}$ = PIB, $R^{20}$ = $R^{22}$ = $R^{27}$ = H

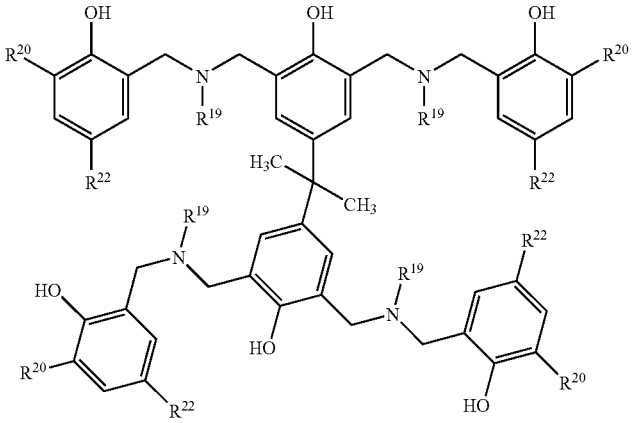

(XXXIIa) $R^{19}$ = methyl, $R^{20}$ = tert-butyl, 3 $R^{22}$ radicals = tert-butyl, 1 $R^{22}$ radical = PIB (XXXIIb) $R^{19}$ = methyl, $R^{20}$ = tert-butyl, 3 $R^{22}$ radicals = methyl, 1 $R^{22}$ radical = PIB (XXXIIc) $R^{19}$ = methyl, 3 $R^{20}$ radicals = tert-butyl, 1 $R^{20}$ radical = H, 3 $R^{22}$ radicals = tert-butyl, 1 $R^{22}$ radical ( on the benzene ring where $R^{20}$ = H) = PIB The sulfur-containing organic compounds with antioxidant action of component (B) are typically low molecular weight or oligomeric organic compounds having a number-average molecular weight $M_n$ of generally not more than 2500, especially not more than 1200, in particular not more than 750.

In a preferred embodiment, the inventive synergistic mixture comprises, as component (B), at least one organic compound having at least one —$(S)_x$— moiety, especially having one or two —$(S)_x$— moieties, in which x is an integer from 1 to 20, preferably from 1 to 10, especially from 1 to 5, in particular 1 or 2. The —$(S)_x$— moieties are preferably either bonded at both sides to carbon atoms of organic radicals and/or to a carbon atom of an organic radical and a hydrogen atom. These organic compounds are usually mercaptans, sulfides, disulfides or polysulfides; they may be of aliphatic or aromatic nature or be heterocyclic ring systems. In the case of a plurality of sulfur atoms in the molecule, mixed sulfide/mercaptan structures may also occur, for example in 2-mercaptobenzthiazole. Organic sulfur compounds only having S—O single bonds or S═O double bonds are typically not suitable as component (B) of the inventive synergistic mixture.

Typical representatives of sulfur-containing organic compounds with antioxidant action as component (B) are the following:

- 2-mercaptobenzthiazole
- 2-mercaptobenzimidazole
- mercaptotriazines such as 2,4,6-trimercaptotriazine-(1,3,5)
- relatively long-chain mercaptans, especially $C_4$- to $C_{30}$-alkanethiols, in particular $C_8$- to $C_{18}$-alkanethiols, such as n-octylthiol, n-decylthiol, n-dodecylthiol, n-tetradecylthiol, n-hexadecylthiol and n-octadecylthiol
- thio glycols such as monothioethylene glycol
- relatively long-chain dialkyl sulfides, especially di-$C_4$- to $C_{30}$-alkyl sulfides, in particular di-$C_8$- to $C_{18}$-alkyl disulfides, such as di-n-octyl sulfide, di-n-decyl sulfide, di-n-dodecyl sulfide, di-n-tetradecyl sulfide, di-n-hexadecyl sulfide and di-n-octadecyl sulfide bis(aralkyl)sulfides such as dibenzyl sulfide bis(aralkyl)disulfides such as dibenzyl disulfide relatively long-chain dialkyl disulfides, especially di-$C_4$- to $C_{30}$-alkyl disulfides, in particular di-$C_8$- to $C_{18}$-alkyl disulfides, such as di-n-octyl disulfide, di-n-decyl disulfide, di-n-dodecyl disulfide, di-n-tetradecyl disulfide, di-n-hexadecyl disulfide and di-n-octadecyl disulfide di($C_4$- to $C_{30}$-alkyl) 3,3'-thiopropionates, especially di($C_8$- to $C_{18}$-alkyl) 3,3'-thiopropionates, such as di-n-octyl 3,3'-thiopropionate, di-n-decyl 3,3'-thiopropionate, di-n-dodecyl 3,3'-thiopropionate, di-n-tetradecyl 3,3'-thiopropionate, di-n-hexadecyl 3,3'-thiopropionate and di-n-octadecyl 3,3'-thiopropionate tetrakis[methylene-2-($C_4$- to $C_{30}$-alkylthio)propionate] methanes, especially tetrakis[methylene-2-($C_8$- to $C_{18}$-alkylthio)propionate]methanes, such as tetrakis[methylene-2-(laurylthio)propionate]methane $C_4$- to $C_{30}$-alkylthiopropylamides, especially $C_8$- to $C_{18}$-alkylthiopropylamides, such as stearylthiopropylamide thiodiethylene bis[3-(3,5-di-tert-butyl-4-hydroxyphenyl) propionate]

2,4-bis($C_4$- to $C_{30}$-alkylthiomethyl)-6-methylphenols, especially 2,4-bis($C_8$- to $C_{18}$-alkylthiomethyl)-6-methylphenols, such as 2,4-bis(octylthiomethyl)-6-methylphenol hydroxyl-containing diaryl sulfides, especially hydroxyl-containing diphenyl sulfides, such as 4,4'-thiobis(2-tert-butyl-5-methylphenol), 4,4'-thiobis(6-tert-butyl-5-methylphenol) and 4,4'-thiobis(2-tert-butyl-6-methylphenol)

zinc salts of dialkyldithiocarbamic acids, such as the zinc salt of dimethyldithiocarbamic acid zinc dialkyldithiophosphates such as zinc di(4-methylpentyl)-2-dithiophosphonate reaction products of terpenes (α-pinene), resin oils or low molecular weight polybutenes with sulfur or thiophenol, for example the reaction products of polyisobutenes with elemental sulfur to give polyisobutyl-substituted sulfur-containing five-membered heterocyclic rings, or with thiophenol to give phenyl polyisobutyl sulfide The inventive synergistic mixture is suitable as a stabilizer for stabilizing inanimate organic material against the action of light, oxygen and heat. This should be understood to mean especially its mode of action as an antioxidant system in the conventional sense. "Antioxidant systems in the conventional sense" should prevent, in the course of storage of inanimate organic material—for example of a fuel or of a mineral oil product—in the presence of ubiquitous oxygen, under the influence of light and/or heat, the formation of reactive oxidation products, especially reactive peroxides, which lead firstly, with decomposition (autoxidation) of the material, to undesired by-products and/or impurities—in the case of fuels, for example, to harmful resinous or tacky precipitates or to harmful hard or lacquer-like precipitates (gum formation)- and secondly may cause damage to surrounding materials such as packaging, components or devices—in the case of fuels, for example, damage or embrittlement of seals or similar components in the engine. To this end, the inventive synergistic mixture is incorporated into the material to be stabilized during or after its production and distributed very homogeneously. The concentration of the inventive synergistic mixture in the organic material to be stabilized is generally from 0.0001 to 5% by weight, preferably from 0.001 to 5% by weight, in particular from 0.01 to 2% by weight, especially from 0.05 to 1% by weight or especially from 0.01 to 0.05% by weight, based in each case on the organic material.

Inanimate organic material is understood to mean, for example, cosmetic preparations such as ointments and lotions, medicament formulations such as pills and suppositories, photographic recording materials, especially photographic emulsions, paints and plastics. They also include especially mineral oil products and fuels, for example diesel fuel, gasoline fuel, turbine fuel, motor oils, lubricant oils, transmission oils and lubricant greases.

Examples of plastics which can be stabilized by the inventive synergistic mixture include:

polymers of mono- or diolefins, such as low- or high-density polyethylene, polypropylene, linear polybutene-1, polyisoprene, polybutadiene and copolymers of mono- or diolefins or mixtures of the polymers mentioned;

polystyrene and copolymers of styrene or α-methylstyrene with dienes and/or acrylic derivatives, for example styrene-butadiene, styrene-acrylonitrile (SAN), styrene-ethyl methacrylate, styrene-butadiene-ethyl acrylate, styrene-acrylonitrile-methacrylate, acrylonitrile-butadiene-styrene (ABS) or methyl methacrylate-butadiene-styrene (MBS); halogenated polymers, for example polyvinyl chloride, polyvinyl fluoride, polyvinylidene fluoride and copolymers thereof;

polymers which derive from α,β-unsaturated acids and derivatives thereof, such as polyacrylates, polymethacrylates, polyacrylamides and polyacrylonitriles;

polymers which derive from unsaturated alcohols and amines or from their acyl derivatives or acetals, for example polyvinyl alcohol and polyvinyl acetate;

polyurethanes, especially thermoplastic polyurethanes, polyamides, polyureas, polyphenylene ethers, polyesters, polycarbonates, polysulfones, polyether sulfones and polyether ketones.

The paints which can be stabilized with the inventive synergistic mixture include coatings such as alkyd resin coatings, dispersion coatings, epoxy resin coatings, polyurethane coatings, acrylic resin coatings and cellulose nitrate coatings, or varnishes such as wood protection varnishes.

The present invention further provides inanimate organic material which comprises at least one inventive synergistic mixture.

The present invention preferably provides a fuel composition which comprises a fuel and at least one inventive synergistic mixture.

The inventive synergistic mixture is particularly advantageously suitable as a stabilizer in turbine fuels (jet fuels). This should also be understood to mean their mode of action as an antioxidant system in the conventional sense. In particular, through its mode of action as a stabilizer, it serves to improve the thermal stability of turbine fuels. Moreover, through its mode of action as a stabilizer, i.e. in its property as a dispersant, it especially also prevents deposits in the fuel system and/or combustion system of turbines. Turbine fuels are used in particular for the operation of aviation turbines.

The present invention further provides a turbine fuel composition which comprises a turbine fuel (jet fuel) and at least one inventive synergistic mixture.

The inventive turbine fuel composition comprises a majority of a liquid turbine fuel, which is, for example, a turbine fuel customary in civilian or military aviation. Examples include fuels of the designation Jet Fuel A, Jet Fuel A-1, Jet Fuel B, Jet Fuel JP-4, JP-5, JP-7, JP-8 and JP-8+100. Jet A and Jet A-1 are commercially available turbine fuel specifications based on kerosene. The corresponding standards are ASTM D 1655 and DEF STAN 91-91. Jet B is a more narrowly cut fuel based on naphtha and kerosene fractions. JP-4 is equivalent to Jet B. JP-5, JP-7, JP-8 and JP-8+100 are military turbine fuels, as used, for example, by the marines and air force.

Some of these standards designate formulations which already comprise further additives, such as corrosion inhibitors, icing inhibitors, static dissipators, etc.

The inventive synergistic mixture can be added to the turbine fuel or to the turbine fuel composition in combination with further additives known per se. Suitable additives which may be present in the inventive turbine fuel composition typically comprise detergents, corrosion inhibitors, sulfur-free antioxidants such as sterically hindered tert-butylphenols, N-butylphenylenediamines and N,N'-diphenylamine and derivatives thereof, metal deactivators such as N,N'-disalicylidene-1,2-diaminopropane, solubilizers, antistats such as Stadis 450, biocides, anti-icing agents such as diethylene glycol methyl ether or triethylene glycol methyl ether, and mixtures of the additives mentioned.

Additives preferred in the context of the present invention are the specific compound classes (C), (D) and (E) detailed below:

Preferred additives (C) are compounds which are derived from succinic anhydride and have long-chain hydrocarbon radicals having generally from 15 to 700, in particular from 30 to 200 carbon atoms. These compounds may have further functional groups which are preferably selected from hydroxyl, amino, amido and/or imido groups. Preferred additives are the corresponding derivatives of polyalkenyl succinic anhydride, which are obtainable, for example, by reaction of polyalkenes with maleic anhydride by a thermal route or via the chlorinated hydrocarbons. The number-average molecular weight of the long-chain hydrocarbon radicals is preferably within a range from about 200 to 10 000, more preferably from 400 to 5000, in particular from 600 to 3000 and especially from 650 to 2000. These long-chain hydrocarbon radicals preferably derive from conventional polyisobutenes and especially from the reactive polyisobutenes mentioned above. Of particular interest as additives (C) are the derivatives of polyalkenyl succinic anhydrides with ammonia, monoamines, polyamines, monoalcohols and polyols. Polyamines preferred for the derivatization comprise ethylenediamine, diethylenetriamine, triethylenetetramine, tetraethylenepentamine, propylenediamine, etc. Suitable alcohols comprise monohydric alcohols such as ethanol, allyl alcohol, dodecanol and benzyl alcohol, polyhydric alcohols such as ethylene glycol, diethylene glycol, propylene glycol, 1,2-butanediol, neopentyl glycol, glycerol, trimethylolpropane, erythritol, pentaerythritol, mannitol and sorbitol. Succinic anhydride derivatives (C) suitable as additives are, for example, described in U.S. Pat. Nos. 3,522,179, 4,234,435, 4,849,572, 4,904,401, 5,569,644 and 6,165,235.

Preferred additives (D) are polyalkenyl thiophosphonates. The polyalkenyl radical of these esters preferably has a number-average molecular weight in the range from about 300 to 5000, more preferably from 400 to 2000 and especially from 500 to 1500. The polyalkenyl radical preferably derives from polyolefins as have been described above as the long-chain hydrocarbon radical for component (C). These are preferably polyalkenyl radicals which derive from conventional or reactive polyisobutenes. Suitable processes for preparing suitable polyalkenyl thiophosphonates by reacting a polyolefin with a thiophosphorylating agent are described, for example, in U.S. Pat. No. 5,725,611.

Preferred additives (E) are further Mannich adducts which differ from the Mannich reaction products of the general formula II to be used in the context of the present invention. Such adducts are in principle obtained by Mannich reaction of aromatic hydroxyl compounds, especially phenol and phenol derivatives, with aldehydes and mono- or polyamines. They are preferably the reaction products of polyisobutene-substituted phenols with formaldehyde and mono- or polyamines such as ethylenediamine, diethylenetriamine, triethylenetetramine, tetraethylenepentamine or dimethylaminopropylamine.

The inventive turbine fuel composition comprises the inventive synergistic composition in an amount of typically from 0.0001 to 1% by weight, preferably from 0.001 to 0.5% by weight, especially from 0.01 to 0.2% by weight, in particular from 0.01 to 0.1% by weight, even more preferably from 0.01 to 0.05% by weight, based in each case on the total amount of the turbine fuel composition.

The additives (C) to (E) and any further additives from those mentioned above may typically each be used in amounts of in each case from 0.0001 to 1% by weight, preferably from 0.001 to 0.6% by weight and especially from 0.0015 to 0.4% by weight, based on the total amount of the turbine fuel composition.

The present invention further provides an additive concentrate for turbine fuels (jet fuels) which comprises at least one inventive synergistic mixture and if appropriate at least one diluent and if appropriate at least one further additive which is preferably selected from those described above. In a preferred embodiment, the inventive additive concentrate comprises, like the inventive turbine fuel composition too, one or more additives from groups (C), (D) and (E), especially also mixtures thereof, such as (C)+(D), (C)+(E), (D)+(E) and (C)+(D)+(E).

Suitable diluents are, for example, fractions obtained in crude oil processing, such as kerosene, naphtha or mineral base oils. Additionally suitable are aromatic and aliphatic hydrocarbons such as Solvent Naphtha heavy, Solvesso® or Shellsol®, and mixtures of these solvents and diluents.

The inventive synergistic mixture is present in the inventive additive concentrate preferably in an amount of from 0.1 to 100% by weight, more preferably from 1 to 80% by weight and especially from 10 to 70% by weight, based on the total weight of the concentrate.

The inventive synergistic mixture is also advantageously suitable as a stabilizer in gasoline fuels and in middle distillate fuels, here especially in diesel fuel and heating oil. This should also be understood to mean their mode of action as an antioxidant system in the conventional sense. In particular, through their mode of action as a stabilizer, they serve to improve the thermal stability of gasoline fuels and middle distillate fuels. Moreover, through their mode of action as a stabilizer, i.e. in their property as a dispersant, they especially also prevent deposits in the fuel system and/or combustion system of gasoline or diesel engines.

Useful gasoline fuels include all commercial gasoline fuel compositions. A typical representative which shall be mentioned here is the Eurosuper base fuel according to EN 228, which is customary on the market. In addition, gasoline fuel compositions of the specification according to WO 00/47698 are also possible fields of use for the present invention.

Useful middle distillate fuels include all commercial diesel fuel and heating oil compositions. Diesel fuels are typically mineral oil raffinates which generally have a boiling range from 100 to 400° C. These are usually distillates having a 95% point up to 360° C. or even higher. They may also be so-called "ultra low sulfur diesel" or "city diesel", characterized by a 95% point of, for example, not more than 345° C. and a sulfur content of not more than 0.005% by weight, or by a 95% point of, for example, 285° C. and a sulfur content of not more than 0.001% by weight. In addition to the diesel fuels obtainable by refining, whose main constituents are relatively long-chain paraffins, suitable diesel fuels are those which are obtainable by coal gasification or gas liquefaction (for example by Fischer-Tropsch synthesis) ["gas to liquid" (GTL) fuels] or from biomass ["biomass to liquid" (BTL) fuels]. Also suitable are mixtures of the aforementioned diesel fuels with renewable fuels such as biodiesel. Of particular interest at the present time are diesel fuels with a low sulfur content, i.e. with a sulfur content of less than 0.05% by weight, preferably of less than 0.02% by weight, in particular of less than 0.005% by weight and especially of less than 0.001% by weight of sulfur. Diesel fuels may also comprise water, for example in an amount up to 20% by weight, for example in the form of diesel-water microemulsions or as so-called "white diesel".

Heating oils are, for example, low-sulfur or sulfur-rich mineral oil raffinates, or bituminous coal distillates or brown coal distillates, which typically have a boiling range of from 150 to 400° C. Heating oils may be standard heating oil according to DIN 51603-1 which has a sulfur content of from 0.005 to 0.2% by weight, or they are low-sulfur heating oils having a sulfur content of from 0 to 0.005% by weight. Examples of heating oil include in particular heating oil for domestic oil-fired boilers or EL heating oil.

The inventive synergistic mixture can either be added to the particular base fuel, especially the gasoline fuel or the diesel fuel, alone or in the form of fuel additive packages, for example the so-called diesel performance packages. Such packages are fuel additive concentrates and comprise generally, as well as solvents, also a series of further components as coadditives, for example carrier oils, cold flow improvers, corrosion inhibitors, demulsifiers, dehazers, antifoams, cetane number improvers, combustion improvers, further antioxidants or stabilizers, antistats, metallocenes, metal deactivators, solubilizers, markers and/or dyes.

In a preferred embodiment, the additized gasoline or diesel fuel, as well as the inventive synergistic mixture, comprises, as further fuel additives, especially at least one detergent, referred to hereinafter as component (F).

Detergents or detergent additives (F) refer typically to deposition inhibitors for fuels. The detergents are preferably amphiphilic substances which have at least one hydrophobic hydrocarbon radical having a number-average molecular weight ($M_n$) of from 85 to 20 000, especially from 300 to 5000, in particular from 500 to 2500, and have at least one polar moiety which is selected from (Fa) mono- or polyamino groups having up to 6 nitrogen atoms, at least one nitrogen atom having basic properties;
(Fb) nitro groups, if appropriate in combination with hydroxyl groups;
(Fc) hydroxyl groups in combination with mono- or polyamino groups, at least one nitrogen atom having basic properties;
(Fd) carboxyl groups or their alkali metal or alkaline earth metal salts;
(Fe) sulfonic acid groups or their alkali metal or alkaline earth metal salts;
(Ff) polyoxy-$C_2$-$C_4$-alkylene moieties which are terminated by hydroxyl groups, mono- or polyamino groups, at least one nitrogen atom having basic properties, or by carbamate groups;
(Fg) carboxylic ester groups;
(Fh) moieties which derive from succinic anhydride and have hydroxyl and/or amino and/or amido and/or imido groups; and/or
(Fi) moieties obtained by Mannich reaction of substituted phenols with aldehydes and mono- or polyamines, which differ from the Mannich reaction products of the general formula II to be used in the context of the present invention.

The hydrophobic hydrocarbon radical in the above detergent additives, which ensures the adequate solubility in the fuel oil composition, has a number-average molecular weight ($M_n$) of from 85 to 20 000, especially from 300 to 5000, in particular from 500 to 2500. Typical hydrophobic hydrocarbon radicals, especially in conjunction with the polar moieties (Fa), (Fc), (Fh) and (Fi), include relatively long-chain alkyl or alkenyl groups, especially the polypropenyl, polybutenyl and polyisobutenyl radical, each having $M_n$=from 300 to 5000, especially from 500 to 2500, in particular from 700 to 2300.

Examples of the above groups of detergent additives include the following:

Additives comprising mono- or polyamino groups (Fa) are preferably polyalkenemono- or polyalkenepolyamines based on polypropene or conventional (i.e. having predominantly internal double bonds) polybutene or polyisobutene having $M_n$=from 300 to 5000. When polybutene or polyisobutene having predominantly internal double bonds (usually in the β- and γ-position) is used as starting material in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylenetriamine, triethylenetetramine or tetraethylenepentamine. Corresponding additives based on polypropene are described in particular in WO-A-94/24231.

Further preferred additives comprising monoamino groups (Fa) are the hydrogenation products of the reaction products of polyisobutenes having an average degree of polymerization P of from 5 to 100 with nitrogen oxides or mixtures of nitrogen oxides and oxygen, as described in particular in WO-A-97/03946.

Further preferred additives comprising monoamino groups (Fa) are the compounds obtainable from polyisobutene epoxides by reaction with amines and subsequent dehydration and reduction of the amino alcohols, as described in particular in DE-A-196 20 262.

Additives comprising nitro groups (Fb), if appropriate in combination with hydroxyl groups, are preferably reaction products of polyisobutenes having an average degree of polymerization P=from 5 to 100 or from 10 to 100 with nitrogen oxides or mixtures of nitrogen oxides and oxygen, as described in particular in WO-A-96/03367 and WO-A-96/03479. These reaction products are generally mixtures of pure nitropolyisobutenes (e.g. α,β-dinitropolyisobutene) and mixed hydroxynitropolyisobutenes (e.g. α-nitro-β-hydroxypolyisobutene).

Additives comprising hydroxyl groups in combination with mono- or polyamino groups (Fc) are in particular reaction products of polyisobutene epoxides obtainable from polyisobutene having preferably predominantly terminal double bonds and $M_n$=from 300 to 5000, with ammonia or mono- or polyamines, as described in particular in EP-A 476 485.

Additives comprising carboxyl groups or their alkali metal or alkaline earth metal salts (Fd) are preferably copolymers of $C_2$-$C_{40}$-olefins with maleic anhydride which have a total molar mass of from 500 to 20 000 and of whose carboxyl groups some or all have been converted to the alkali metal or alkaline earth metal salts and any remainder of the carboxyl groups has been reacted with alcohols or amines. Such additives are disclosed in particular by EP-A-307 815. Such additives serve mainly to prevent valve seat wear and can, as described in WO-A-87/01126, advantageously be used in combination with customary fuel detergents such as poly(iso)buteneamines or polyetheramines.

Additives comprising sulfonic acid groups or their alkali metal or alkaline earth metal salts (Fe) are preferably alkali metal or alkaline earth metal salts of an alkyl sulfosuccinate, as described in particular in EP-A-639 632. Such additives serve mainly to prevent valve seat wear and can be used advantageously in combination with customary fuel detergents such as poly(iso)buteneamines or polyetheramines.

Additives comprising polyoxy-$C_2$-$C_4$-alkylene moieties (Ff) are preferably polyethers or polyetheramines which are obtainable by reaction of $C_2$-$C_{60}$-alkanols, $C_6$-$C_{30}$-alkanediols, mono- or di-$C_{2030}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyetheramines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising carboxylic ester groups (Fg) are preferably esters of mono-, di- or tricarboxylic acids with long-chain alkanols or polyols, in particular those having a minimum viscosity of 2 $mm^2/s$ at 100° C., as described in particular in DE-A-38 38 918. The mono-, di- or tricarboxylic acids used may be aliphatic or aromatic acids, and particularly suitable ester alcohols or ester polyols are long-chain representatives having, for example, from 6 to 24 carbon atoms. Typical representatives of the esters are adipates, phthalates, isophthalates, terephthalates and trimellitates of isooctanol, of isononanol, of isodecanol and of isotridecanol. Such products also have carrier oil properties.

Additives comprising moieties derived from succinic anhydride and having hydroxyl and/or amino and/or amido and/or imido groups (Fh) are preferably corresponding derivatives of alkyl- or alkenyl-substituted succinic anhydride and especially the corresponding derivatives of polyisobutenylsuccinic anhydride which are obtainable by reacting conventional or high-reactivity polyisobutene having $M_n$=from 300 to 5000 with maleic anhydride by a thermal route or via the chlorinated polyisobutene. Particular interest attaches to derivatives with aliphatic polyamines such as ethylenediamine, diethylenetriamine, triethylenetetramine or tetraethylenepentamine. The moieties having hydroxyl and/or amino and/or amido and/or imido groups are, for example, carboxylic acid groups, acid amides of monoamines, acid amides of di- or polyamines which, in addition to the amide function, also have free amine groups, succinic acid derivatives having an acid and an amide function, carboximides with monoamines, carboximides with di- or polyamines which, in addition to the imide function, also have free amine groups, or diimides which are formed by the reaction of di- or polyamines with two succinic acid derivatives. Such fuel additives are described in particular in U.S. Pat. No. 4,849,572.

The detergent additives from group (Fh) are preferably the reaction products of alkyl- or alkenyl-substituted succinic anhydrides, especially of polyisobutenylsuccinic anhydrides, with amines and/or alcohols. These are thus derivatives which are derived from alkyl-, alkenyl- or polyisobutenylsuccinic anhydride and have amino and/or amido and/or imido and/or hydroxyl groups. It will be appreciated that these reaction products are not only obtainable when substituted succinic anhydride is used, but also when substituted succinic acid or suitable acid derivatives, such as succinyl halides or succinic esters, are used. The additized fuel preferably comprises at least one detergent based on a polyisobutenyl-substituted succinimide. Especially of interest are the imides with aliphatic polyamines. Particularly preferred polyamines are ethylenediamine, diethylenetriamine, triethylenetetramine, pentaethylenehexamine and in particular tetraethylenepentamine. The polyisobutenyl radical has a number-average molecular weight $M_n$ of preferably from 500 to 5000, more preferably from 500 to 2000 and in particular of about 1000.

Additives comprising moieties (Fi) obtained by Mannich reaction of substituted phenols with aldehydes and mono- or polyamines are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or high-reactivity polyisobutene having $M_n$=from 300 to 5000. Such "polyisobutene-Mannich bases" are described in particular in EP-A-831 141.

Preference is given to using the detergent additives (F) mentioned together with the inventive synergistic mixture in combination with at least one carrier oil.

Suitable mineral carrier oils are the fractions obtained in crude oil processing, such as brightstock or base oils having viscosities, for example, from the SN 500-2000 class; but also aromatic hydrocarbons, paraffinic hydrocarbons and alkoxyalkanols. Likewise useful is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized). Likewise suitable are mixtures of abovementioned mineral carrier oils.

Examples of suitable synthetic carrier oils are selected from: polyolefins (poly-alpha-olefins or poly(internal olefin)s), (poly)esters, (poly)alkoxylates, polyethers, aliphatic polyetheramines, alkylphenol-started polyethers, alkylphenol-started polyetheramines and carboxylic esters of long-chain alkanols.

Examples of suitable polyolefins are olefin polymers having $M_n$=from 400 to 1800, in particular based on polybutene or polyisobutene (hydrogenated or unhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclo-hexanols or $C_1$-$C_{30}$-alkylphenols with from 1 to 30 mol of ethylene oxide and/or propylene oxide and/or butylene oxide per hydroxyl group or amino group, and, in the case of the polyetheramines, by subsequent reductive amination with ammonia, monoamines or polyamines. Such products are described in particular in EP-A-310 875, EP-A-356 725, EP-A-700 985 and U.S. Pat. No. 4,877,416. For example, the polyetheramines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di(n- or isotridecyl)phthalate.

Further suitable carrier oil systems are described, for example, in DE-A-38 26 608, DE-A-41 42 241, DE-A-43 09 074, EP-A-0 452 328 and EP-A-0 548 617.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Nonlimiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-101 02 913.

Preferred carrier oils are synthetic carrier oils, particular preference being given to polyethers.

The detergent additive (F) or a mixture of different such detergent additives is added to the additized fuel in a total amount of preferably from 10 to 2000 ppm by weight, more preferably from 20 to 1000 ppm by weight, even more preferably from 50 to 500 ppm by weight and in particular from 50 to 200 ppm by weight, for example from 70 to 150 ppm by weight.

When a carrier oil is used additionally, it is added to the inventive additized fuel in an amount of preferably from 1 to 1000 ppm by weight, more preferably from 10 to 500 ppm by weight and in particular from 20 to 100 ppm by weight.

Cold flow improvers suitable as further coadditives are, for example, copolymers of ethylene with at least one further unsaturated monomer, for example ethylene-vinyl acetate copolymers.

Corrosion inhibitors suitable as further coadditives are, for example, succinic esters, in particular with polyols, fatty acid derivatives, for example oleic esters, oligomerized fatty acids and substituted ethanolamines.

Demulsifiers suitable as further coadditives are, for example, the alkali metal and alkaline earth metal salts of alkyl-substituted phenol- and naphthalenesulfonates and the alkali metal and alkaline earth metal salts of fatty acid, and also alcohol alkoxylates, e.g. alcohol ethoxylates, phenol alkoxylates, e.g. tert-butylphenol ethoxylates or tert-pentylphenol ethoxylates, fatty acid, alkylphenols, condensation products of ethylene oxide and propylene oxide, e.g. ethylene oxide-propylene oxide block copolymers, polyethyleneimines and polysiloxanes.

Dehazers suitable as further coadditives are, for example, alkoxylated phenol-formaldehyde condensates.

Antifoams suitable as further coadditives are, for example, polyether-modified polysiloxanes.

Cetane number and combustion improvers suitable as further coadditives are, for example, alkyl nitrates, e.g. cyclohexyl nitrate and especially 2-ethylhexyl nitrate, and peroxides, e.g. di-tert-butyl peroxide.

Sulfur-free antioxidants suitable as further coadditives are, for example, substituted phenols, e.g. 2,6-di-tert-butylphenol and 2,6-di-tert-butyl-3-methylphenol, and also phenylenediamines, e.g. N,N'-di-sec-butyl-p-phenylenediamine.

Metal deactivators suitable as further coadditives are, for example, salicylic acid derivatives, e.g. N,N'-disalicylidene-1,2-propanediamine.

Suitable solvents, especially for fuel additive packages, are, for example, nonpolar organic solvents, especially aromatic and aliphatic hydrocarbons, for example toluene, xylenes, "white spirit" and the technical solvent mixtures of the designations Shellsol® (manufacturer: Royal Dutch/Shell Group), Exxol® (manufacturer: ExxonMobil) and Solvent Naphtha. Also useful here, especially in a blend with the nonpolar organic solvents mentioned, are polar organic solvents, in particular alcohols such as 2-ethylhexanol, 2-propylheptanol, decanol and isotridecanol.

When the coadditives and/or solvents mentioned are used additionally in gasoline fuel or diesel fuel, they are used in the amounts customary therefor.

The inventive synergistic mixture is also particularly advantageously suitable as a stabilizer in lubricants. Lubricants or lubricant compositions shall refer here to motor oils, lubricant oils, transmission oils including manual and automatic oils, and related liquid compositions which serve to lubricate mechanically moving parts—usually as metal. Stabilization should be understood here in particular to mean the improvement of the oxidation and ageing stability of lubricant compositions, i.e. their mode of action especially as an "antioxidant system in the conventional sense". Additionally or alternatively, the inventive synergistic mixture improves the shear stability of lubricant compositions, i.e. the inventive synergistic mixture thickens the lubricant compositions more effectively. In some cases, the inventive synergistic mixture also acts as a dispersant in lubricant compositions.

The present invention further provides a lubricant material composition which comprises components customary therefor and at least one inventive synergistic mixture. The inventive lubricant composition comprises the inventive synergistic mixture in an amount of typically from 0.001 to 20% by weight, preferably from 0.01 to 10% by weight, especially from 0.05 to 8% by weight and in particular from 0.1 to 5% by weight, based on the total amount of the lubricant composition.

The economically most significant lubricant compositions are motor oils, and also transmission oils including manual and automatic oils. Motor oils consist typically of mineral base oils which comprise predominantly paraffinic constituents and are produced in the refinery by costly inconvenient workup and purification processes, having a fraction of from approx. 2 to 10% by weight of additives (based on the active substance contents). For specific applications, for example high-temperature applications, the mineral base oils may be replaced partly or fully by synthetic components such as organic esters, synthetic hydrocarbons such as olefin oligomers, poly-α-olefins or polyolefins or hydrocracking oils. Motor oils also have to have sufficiently high viscosities at high temperatures in order to ensure impeccable lubrication effect and good sealing between cylinder and piston. Moreover, the flow properties of motor oils have to be such that the engine can be started without any problem at low temperatures. Motor oils have to be oxidation-stable and must generate only small amounts of decomposition products in liquid or solid form and deposits even under difficult working conditions. Motor oils disperse solids (dispersant behavior), prevent deposits (detergent behavior), neutralize acidic reaction products and form a wear protective film on the metal surfaces in the engine. Motor oils are typically characterized by viscosity classes (SAE classes).

With regard to their base components and additives, transmission oils including manual and automatic oils have a similar composition to motor oils. The force is transmitted in the gear system of gearboxes to a high degree through the liquid pressure in the transmission oil between the teeth. The transmission oil accordingly has to be such that it withstands high pressures for prolonged periods without decomposing.

In addition to the viscosity properties, wear, pressure resistance, friction, shear stability, traction and running-in performance are the crucial parameters here.

In addition to the inventive synergistic mixture, motor oils and transmission oils including manual and automatic oils generally also comprise at least one, but usually some or all, of the additives listed below in the amounts generally customary therefor (which are stated in brackets in % by weight, based on the overall amount of lubricant composition):

(a) sulfur-containing antioxidants which differ from the sulfur-containing antioxidants of component (B) to be used in the context of the present invention, and/or sulfur-free antioxidants (from 0.1 to 5%):
- phosphorus compounds, for example triaryl and trialkyl phosphites, dialkyl 3,5-di-tert-butyl-4-hydroxybenzylphosphonate or phosphonic acid piperazides
- sulfur-phosphorus compounds, for example zinc dialkyldithiophosphates (metal dialkyldithiophosphates also act as corrosion inhibitors and high-pressure additives in lubricant oils) or reaction products of phosphorus pentasulfide with terpenes (α-pinene, dipentene), polybutenes, olefins or unsaturated esters
- phenol derivatives, for example sterically hindered mono-, bis- or trisphenols, sterically hindered polycyclic phenols, polyalkylphenols, 2,6-di-tert-butyl-4-methylphenol or methylene-4,4'-bis(2,6-di-tert-butylphenol) (phenol derivatives are often used in combination with sulfur-based or amine-based antioxidants)
- amines, for example arylamines such as diphenylamine, phenyl-α-naphthylamine or 4,4'-tetramethyldiaminodiphenylmethane
- metal deactivators in the narrower sense, for example N-salicylideneethylamine, N,N'-disalicylideneethylenediamine, N,N'-disalicylidene-1,2-propanediamine, triethylenediamine, ethylenediaminetetraacetic acid, phosphoric acid, citric acid, glycolic acid, lecithin, thiadiazole, imidazole or pyrazole derivatives (b) viscosity index improvers (from 0.05 to 10%), for example: polyisobutenes having a molecular weight of typically from 10 000 to 45 000, polymethacrylates having a molecular weight of typically from 15 000 to 100 000, homo- and copolymers of 1,3-dienes such as butadiene or isoprene having a molecular weight of typically from 80 000 to 100 000, 1,3-diene-styrene copolymers having a molecular weight of typically from 80 000 to 100 000, maleic anhydride-styrene polymers in esterified form having a molecular weight of typically from 60 000 to 120 000, star-shaped polymers with block-like structure by virtue of units composed of conjugated dienes and aromatic monomers having a molecular weight of typically from 200 000 to 500 000, polyalkylstyrenes having a molecular weight of typically from 80 000 to 150 000, polyolefins composed of ethylene and propylene or styrene-cyclopentadiene-norbornene terpolymers having a molecular weight of typically from 60 000 to 140 000

(c) pour point depressants (cold flow improvers) (from 0.03 to 1%), for example bicyclic aromatics such as naphthalene with different long-chain alkyl radicals, polymethacrylates with from 12 to 18 carbon atoms in the alcohol radical, a degree of branching between 10 to 30 mol % and an average molecular weight of from 5000 to 500 000, long-chain alkylphenols and dialkylaryl phthalates or copolymers of different olefins (d) detergents (HD additives) (from 0.2 to 4%), for example calcium naphthenates, lead naphthenates, zinc naphthenates and manganese naphthenates, calcium dichlorostearates, calcium phenylstearates, calcium chlorophenylstearates, sulfonation products of alkylaromatics such as dodecylbenzene, petroleum sulfonates, sodium sulfonates, calcium sulfonates, barium sulfonates or magnesium sulfonates, neutral, basic and overbased sulfonates, phenates and carboxylates, salicylates, metal salts of alkylphenols and alkylphenol sulfides, phosphates, thiophosphates or alkenylphosphonic acid derivatives (e) ashless dispersants (from 0.5 to 10%), for example Mannich condensates of alkylphenol, formaldehyde and polyalkylenepolyamines, which differ from the Mannich reaction products of the general formula II to be used in the context of the present invention, reaction products of polyisobutenylsuccinic anhydrides with polyhydroxyl compounds or polyamines, copolymers of alkyl methacrylates with diethylaminoethyl methacrylate, N-vinylpyrrolidone, N-vinylpyridine or 2-hydroxyethyl methacrylate or vinyl acetate-fumarate copolymers (f) high-pressure additives (extreme pressure additives) (from 0.2 to 2.5%), for example chlorinated paraffins with chlorine content from 40 to 70% by weight, chlorinated fatty acid (especially having trichloromethyl end groups), dialkyl hydrogenphosphites, triaryl phosphites, aryl phosphates such as tricresyl phosphate, dialkyl phosphates, trialkyl phosphates such as tributyl phosphate, trialkylphosphines, diphosphoric esters, nitroaromatics, aminophenol derivatives of naphthenic acid, carbamic esters, dithiocarbamic acid derivatives, substituted 1,2,3-triazoles, mixtures of benzotriazole and alkylsuccinic anhydride or alkylmaleic anhydride, 1,2,4-thiadiazole polymers, morpholinobenzothiadiazole disulfide, chlorinated alkyl sulfides, sulfurized olefins, sulfurized chloronaphthalenes, chlorinated alkyl thiocarbonates, organic sulfides and polysulfides such as bis(4-chlorobenzyl)disulfide and tetrachlorodiphenyl sulfide, trichloroacrolein mercaptals or especially zinc dialkyldithiophosphates (ZDDPs)

(g) friction modifiers (from 0.05 to 1%), especially polar oil-soluble compounds which generate a thin layer on the frictional surface by adsorption, for example fatty alcohols, fatty amides, fatty acid salts, fatty acid alkyl esters or fatty acid glycerides (h) antifoam additives (from 0.0001 to 0.2%), for example liquid silicones such as polydimethylsiloxanes or polyethylene glycol ethers and sulfides (i) demulsifiers (from 0.1 to 1%), for example dinonylnaphthalenesulfonates in the form of their alkali metal and alkaline earth metal salts (j) corrosion inhibitors (also known as metal deactivators) (from 0.01 to 2%), for example tertiary amines and salts thereof, imino esters, amide oximes, diaminomethanes, derivatives of saturated or unsaturated fatty acids with alkanolamines, alkylamines, sarcosines, imidazolines, alkylbenzotriazoles, dimercaptothiadiazole derivatives, diaryl phosphates, thiophosphoric esters, neutral salts of primary n-$C_8$-$C_{18}$-alkylamines or cycloalkylamines with dialkyl phosphates having branched $C_5$-$C_{12}$-alkyl groups, neutral or basic alkaline earth metal sulfonates, zinc naphthenates, mono- and dialkylarylsulfonates, barium dinonylnaphthalenesulfonates, lanolin (wool fat), heavy metal salts of naphthenic acid, dicarboxylic acid, unsaturated fatty acids, hydroxy fatty acids, fatty acid esters, pentaerythrityl monooleates and sorbitan monooleates, O-stearoylalkanolamines, polyisobutenylsuccinic acid derivatives or zinc dialkyldithiophosphates and zinc dialkyldithiocarbamates (k) emulsifiers (from 0.01 to 1%), for example long-chain unsaturated, naturally occurring carboxylic acid, naphthenic acids, synthetic carboxylic acid, sulfonamides, N-oleylsarcosine, alkanesulfamidoacetic acid, dodecylbenzenesulfonate, long-chain alkylated ammonium salts such as dimethyldodecylbenzylammonium chloride, imidazolinium salts, alkyl-, alkylaryl-, acyl-, alkylamino- and acylaminopolyglycols or long-chain acylated mono- and diethanolamines (l) dyes and fluorescence additives (from 0.001 to 0.2%)

(m) preservatives (from 0.001 to 0.5%)

(n) odor improvers (from 0.001 to 0.2%).

Typical ready-to-use motor oil compositions and transmission oil, including manual and automatic oil, compositions in the context of the present invention have the following composition, the data for the additives relating to the active substance contents and the sum of all components always adding up to 100% by weight:

- from 80 to 99.3% by weight, in particular from 90 to 98% by weight, of motor oil base or transmission oil, including manual and automatic oil, base (mineral base oils and/or synthetic components) including the fractions of solvent and diluent for the additives
- from 0.1 to 8% by weight of the inventive synergistic mixture
- from 0.2 to 4% by weight, in particular from 1.3 to 2.5% by weight, of detergents of group (d)
- from 0.5 to 10% by weight, in particular from 1.3 to 6.5% by weight, of dispersants of group (e)
- from 0.1 to 5% by weight, in particular from 0.4 to 2.0% by weight, of antioxidants of group (a) and/or high-pressure additives of group (f) and/or friction modifiers of group (g)
- from 0.05 to 10% by weight, in particular from 0.2 to 1.0% by weight, of viscosity index improvers of group (b)
- from 0 to 2% by weight of other additives of groups (c) and (h) to (n).

The invention will be illustrated in detail with reference to the nonrestrictive examples which follow.

PREPARATION EXAMPLES

The following compounds were used as component (A) in the inventive synergistic mixture:

(A1) 2-aminomethyl-4-polyisobutyl-6-tert-butylphenol of the general formula II ($R^2$=tert-butyl, $R^6$=$R^7$=hydrogen, $M_n$ of the polyisobutyl radical=1000), prepared according to the teaching of document (1) by alkylating 2-tert-butylphenol with polyisobutene and subsequent reaction with formaldehyde and ammonia; if, instead of 2-aminomethyl-4-polyisobutyl-6-tert-butylphenol, 2-(N,N-dimethylaminomethyl)-4-polyisobutyl-6-tert-butylphenol ($R^2$=tert-butyl, $R^6$=$R^7$=methyl, $M_n$ of the polyisobutyl radical=1000), which is obtainable in an analogous manner by alkylating 2-tert-butylphenol with polyisobutene and subsequent reaction with formaldehyde and dimethylamine, is used, the same results are achieved in the application examples adduced below (A2) polyisobutyl-substituted tetrahydrobenzoxazine of the formula Vb, prepared according to the teaching of document (4)

(A3) polycyclic phenolic compound having 3 benzene rings of the formula XXXc, prepared according to the preparation example adduced below

Preparation Example for A3

A 500 ml four-neck flask was initially charged with 120 g of 4-polyisobutenylphenol, prepared from polyisobutene having a number-average molecular weight $M_n$ of 1000 and a content of terminal vinylidene double bonds of 80 mol % (Glissopal® 1000 from BASF Aktiengesellschaft), at room temperature in 100 ml of toluene, and 48 g of the tetrahydrobenzoxazine of the general formula Vg were added within 15 minutes. The flask contents were heated to reflux and stirred under reflux for 2 hours. After cooling to room temperature, the mixture was washed with methanol and the toluene phase was concentrated under reduced pressure (5 mbar) at 150° C. 113 g of a clear, light-colored, viscous oil were obtained.

$^1$H NMR (400 MHz, 16 scans, $CDCl_3$):

δ=3.8-3.5 ppm (benzyl protons), δ=2.6-2.0 ppm (methylamine protons), δ=6.9-7.2 ppm (aromatic protons)

The following sulfur-containing organic compounds were used as component (B) in the inventive synergistic mixture:

(B1) 4,4'-thiobis(2-tert-butyl-6-methylphenol), commercially available product; if, instead of 4,4'-thiobis(2-tert-butyl-6-methylphenol), the likewise commercially available structural isomer 4,4'-thiobis(2-tert-butyl-5-methylphenol) is used, the same results are obtained in the application examples adduced below (B2) phenyl polyisobutyl sulfide, prepared by the preparation example given below for B2

(B3) reaction product of polyisobutene with elemental sulfur to give polyisobutyl-substituted sulfur-containing five-membered heterocyclic rings, prepared by the preparation example given below for B3

Preparation Example for B2

A 2 liter four-neck flask was initially charged with 90 g of thiophenol under an argon protective gas atmosphere. 7 g of boron trifluoride phenolate were added rapidly at room temperature. A solution of 800 g of polyisobutene having a number-average molecular weight $M_n$ of 1000 and a content of terminal vinylidene double bonds of 80 mol % (Glissopal® 1000 from BASF Aktiengesellschaft) in 400 ml of hexane was added dropwise at 20° C. with cooling within 24 hours. After the addition had ended, the mixture was stirred at room temperature for another 3 hours. For workup, 250 ml of methanol were added, and the hexane phase was diluted with further hexane and washed twice more with 500 ml of methanol each time. After the hexane had been distilled off under reduced pressure (5 mbar) at 120° C., 846 g of phenyl polyisobutyl sulfide were obtained in the form of a light-colored oil.

$^1$H NMR (400 MHz, 16 scans, $CDCl_3$):

δ=7.51 ppm, 2H, aromatic protons; δ=7.32 ppm, 2H, aromatic protons; δ=1.78 ppm, 2H, polyisobutyl protons; further polyisobutyl protons

Preparation Example for B3

700 g of polyisobutene having a number-average molecular weight $M_n$ of 1000 and a content of terminal vinylidene double bonds of 80 mol % (Glissopal® 1000 from BASF Aktiengesellschaft), together with 120 g of sulfur powder, were purged three times with nitrogen in a 2 liter laboratory autoclave at 100° C. Thereafter, with the aid of a metal bath, the mixture was heated to 220° C. for 1 hour and then to 240° C. for 1 hour. A needle valve was used to keep the internal pressure at 5 bar. Hydrogen sulfide which formed in the reaction and escaped via the needle valve was absorbed with chlorine bleach in a washing tower and decomposed. For workup, the mixture was diluted with 1000 ml of heptane, the solid was filtered off and the solution was concentrated under a rotary evaporator at 140° C. and 5 mbar. 750 g of product were obtained in the form of a brown oil which, according to $^1$H NMR analysis, comprised, as main components, the two polyisobutyl-substituted five-membered sulfur heterocycles B3/I and B3/II shown below:

(B3/I)

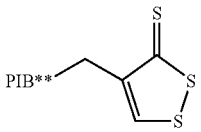

(B3/II)

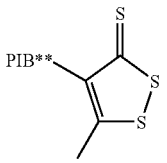

(PIB** denotes the radical from the Glissopal® 1000 used, shortened by one polyisobutene unit)

$^1$H NMR (400 MHz, 16 scans, $CDCl_3$):

B3/I: δ=8.21 ppm, 1H; δ=2.77 ppm, 2H

B3/II: δ=2.44 ppm, 3H; δ=2.00 ppm, 2H; δ=1.58 ppm, 6H

Inventive synergistic mixtures were prepared from components A1 to A3 in each case by mixing with components B1 to B3, and a portion thereof was used in the use examples which follow.

USE EXAMPLES

Example 1

Testing of the Thermal Stability of Turbine Fuel (Jet Fuel) by Determining the Amount of Particles Formed In each case, a commercial turbine fuel of the Jet A specification according to ASTM D 1655 was used. The additization was effected in each case with the amounts specified below of the mixtures or formulations M1 to M7 specified below, which comprised the components A1 to A3 and/or B1 or B2 specified above.

| | | |
|---|---|---|
| M1 (for comparison) | 40% by weight of | A3, |
| | 10% by weight of | 2,6-di-tert-butyl-4-methylphenol ("BHT") (sulfur-free antioxidant), |
| | 4% by weight of | commercial metal deactivator and |
| | 46% by weight of | Solvent Naphtha Heavy (solvent) |
| M2 (inventive) | 40% by weight of | A3, |
| | 8% by weight of | B1, |
| | 10% by weight of | 2,6-di-tert-butyl-4-methylphenol ("BHT") (sulfur-free antioxidant), |
| | 4% by weight of | commercial metal deactivator and |
| | 38% by weight of | Solvent Naphtha Heavy (solvent) |
| M3 (for comparison) | 100% by weight of | A1 |
| M4 (for comparison) | 100% by weight of | B2 |
| M5 (inventive) | 50% by weight of | A1 and |
| | 50% by weight of | B2 |
| M6 (inventive) | 30% by weight of | A2, |
| | 10% by weight of | B1, |
| | 10% by weight of | 2,6-di-tert-butyl-4-methylphenol ("BHT") (sulfur-free antioxidant), |
| | 5% by weight of | commercial metal deactivator, |
| | 30% by weight of | Solvent Naphtha Heavy (solvent) and |
| | 15% by weight of | 2-ethylhexanol (solvent) |
| M7 (for comparison) | 30% by weight of | A2, |
| | 10% by weight of | 2,6-di-tert-butyl-4-methylphenol ("BHT") (sulfur-free antioxidant), |
| | 5% by weight of | commercial metal deactivator, |
| | 30% by weight of | Solvent Naphtha Heavy (solvent) and |
| | 25% by weight of | 2-ethylhexanol (solvent) |

In a three-neck glass flask which had been equipped with stirrer, reflux condenser and thermometer, 5 of air were initially passed through 150 ml of the fuel to be analyzed at room temperature within 1 h. Subsequently, the fuel was heated to 160° C. with an oil bath and stirred at this temperature for a further 5 h. After cooling to room temperature, the entire amount of fuel was filtered through a 0.45 μm membrane filter. Subsequently, the filter residue, after drying in a drying cabinet at 115° C. for 45 min and subsequently drying under reduced pressure for 2 hours, was determined gravimetrically in a desiccator.

Table 1 which follows shows the results of the gravimetric determinations:

TABLE 1

| Sample | Fuel | Dosage | Result |
|---|---|---|---|
| Blank value | No. 1 | 0 | 11.0 mg |
| M1 | No. 1 | 250 mg/l | 2.2 mg |
| M2 | No. 1 | 250 mg/l | 1.4 mg |
| Blank value | No. 2 | 0 | 15.7 mg |
| M3 | No. 2 | 200 mg/l | 13.2 mg |
| M4 | No. 2 | 200 mg/l | 16.3 mg |
| M5 | No. 2 | 200 mg/l | 9.7 mg |
| Blank value | No. 3 | 0 | 13.2 mg |
| M6 | No. 3 | 150 mg/l | 3.0 mg |
| M7 | No. 3 | 150 mg/l | 3.4 mg |
| M6 | No. 3 | 30 mg/l | 7.8 mg |
| M7 | No. 3 | 30 mg/l | 8.3 mg |

In all cases, the inventive mixtures or formulations provide significantly better results, i.e. smaller amounts of filter residue than the corresponding comparative samples. As a result of the use of the inventive synergistic mixture, it was thus possible to significantly reduce the amount of particles formed through thermal stress on the turbine fuel.

The synergism between components (A) and (B) can be seen clearly, for example, by the result of samples M3, M4 and M5: B2 in M4 exhibits no antioxidant action whatsoever (the amount of particles is even increased compared to the blank value); when B2, which is ineffective per se, is mixed with A1, which is already moderately effective in M3, an unexpectedly high jump in the activity occurs once again.

Example 2

Testing of the Water Removal Properties from Turbine Fuel by Measuring the Opacity of the Fuel Phase A commercial turbine fuel (jet fuel) of the Jet A-1 specification according to DEF STAN 91-91 was used. The tendency of the turbine fuels with regard to their water removal properties was tested to ASTM D 3948 ("MSEP" test). What is characteristic of these measurements is the use of a standard coalescing filter with final opacity measurement of the fuel phase. In the measurement, the mixtures M8 to M10 specified below were tested, which comprised the above-specified components A1 to A3 and B1 in combination with the sulfur-free antioxidant 2,6-di-tert-butyl-4-methylphenol ("BHT") and the metal deactivator N,N'-disalicylidene-1,2-diaminopropane. The dosage of the mixture used was in each case 500 mg/l. Marks for the opacity behavior reported in table 2 below were determined [relative evaluation scale from 0 (worst mark) to 100 (best mark)].

| | | |
|---|---|---|
| M8 | 30% by weight of | A1, |
| (inventive) | 10% by weight of | B1, |
| | 10% by weight of | 2,6-di-tert-butyl-4-methylphenol ("BHT"), |
| | 5% by weight of | N,N'-disalicylidene-1,2-diaminopropane, |
| | 30% by weight of | Solvent Naphtha Heavy (solvent) and |
| | 15% by weight of | 2-ethylhexanol (solvent) |
| M9 | 30% by weight of | A2, |
| (inventive) | 10% by weight of | B1, |
| | 10% by weight of | 2,6-di-tert-butyl-4-methylphenol ("BHT"), |
| | 5% by weight of | N,N'-disalicylidene-1,2-diaminopropane, |
| | 30% by weight of | Solvent Naphtha Heavy (solvent) and |
| | 15% by weight of | 2-ethylhexanol (solvent) |
| M10 | 30% by weight of | A3, |
| (inventive) | 10% by weight of | B1, |
| | 10% by weight of | 2,6-di-tert-butyl-4-methylphenol ("BHT"), |
| | 5% by weight of | N,N'-disalicylidene-1,2-diaminopropane, |
| | 30% by weight of | Solvent Naphtha Heavy (solvent) and |
| | 15% by weight of | 2-ethylhexanol (solvent) |

TABLE 2

| Sample | Mark |
|---|---|
| Blank value | 100 |
| M8 | 83 |
| M9 | 100 |
| M10 | 97 |

Virtually no, if any, deteriorations in the water removal properties from turbine fuels compared to unadditized turbine fuel occur with mixtures M9 and M10, and slight but not disadvantageous deteriorations with mixture M8.

Example 3

Testing of the Thermal Stability of Turbine Fuel (Jet Fuel) by Determining the Breakpoint A commercial JP-8 turbine fuel according to MIL-DTL-83133E was used. The thermal stability was tested by the JFTOT breakpoint method to ASTM D 3241. For the turbine fuel not additized with the inventive synergistic mixture, a value of 290° C. was determined. With the same fuel additized with 250 mg/l of sample M10, a breakpoint of 340° C. was measured, and, for the same fuel additized with 1000 mg/ml of sample M10, a breakpoint of 350° C. was measured.

Example 4

Testing of the Water Removal Properties of Turbine Fuel by Determining the Residual Water Content in the Fuel A commercial JP-8 turbine fuel according to MIL-DTL-83133E was used. For the determination of the residual water content in the fuel after the removal of water, a 5 liter vessel with an incorporated coalescence filter element was used. The fuel converted to an emulsion by intensive stirring in a reservoir with 1% by weight of water, for removal of water, was passed at 22° C. through the coalescence filter and the residual water content of the fuel phase was determined by means of Karl-Fischer titration. The less residual water in the fuel, the better are the water removal properties. This is because additives used in the turbine fuel typically worsen the water removal properties, for example in the case of use of coalescence filters.

Commercial JP-8 turbine fuel according to MIL-DTL-83133E additized with customary antistats, corrosion inhibitors and antiwear additives and deicing agents in the customary amounts had, after emulsification and water removal by the above-described test method, a residual water content of 564 ppm by weight ("comparative value"). Unadditized commercial JP-8 turbine fuel according to MIL-DTL-83133E, which had been treated beforehand with alumina to remove the abovementioned additives, had, after emulsification and water removal by the above-described test method, a residual water content of 83 ppm by weight ("blank value"). The same turbine fuel addized with customary antistats, corrosion inhibitors or antiwear additives and deicers in the customary amounts, before performance of emulsification and water removal, was additionally admixed with 250 mg/l of sample M10 and had, at the end, a residual water content of 91 ppm by weight instead of 564 ppm by weight. The value of 91 ppm by weight achieved in accordance with the invention is thus within the order of magnitude of the "blank value" of 83 ppm by weight.

While the presence of additives in turbine fuels normally brings about a significant deterioration in the water removal properties, i.e. an increase in the residual water content, residual water contents in the order of magnitude of unadditized turbine fuel occur when the inventive synergistic mixture is used. The addition of the inventive synergistic mixture even eliminates the adverse effect of additives already present on the water removal properties.

The invention claimed is:

1. A synergistic mixture, comprising:

(A) from 50 to 95% by weight of a compound having a structural element which is at least one of (A1) a tetrahydrobenzoxazine of formula (IV)

(IV)

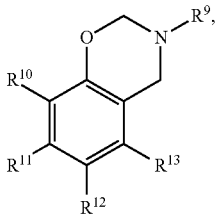

wherein $R^9$ is a hydrocarbyl radical comprising from 1 to 3000 carbon atoms and may be interrupted by one or more heteroatoms from the group of O and S and/or by one or more $NR^{14}$ moieties, $R^{14}$ is a hydrogen atom or a $C_1$- to $C_4$-alkyl radical, and $R^{10}$, $R^{11}$, $R^{12}$, and $R^{13}$ are each independently hydrogen atoms, hydroxyl groups, or hydrocarbyl radicals comprising in each case from 1 to 3000 carbon atoms and may be interrupted by one or more heteroatoms from the group of O and S and/or by one or more $NR^{14}$ moieties, $R^{12}$ may also be a radical of formula (Y)

(Y)

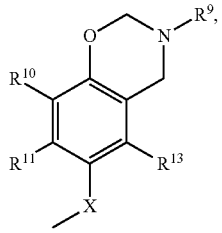

wherein

X is a hydrocarbon bridging member which comprises one or more isobutene units, or $R^{12}$ may also be a radical of the formula (Z) or (Z')

(Z)

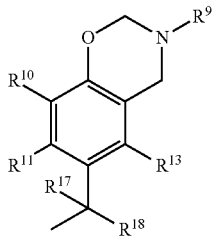

(Z')

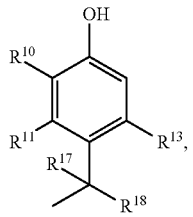

wherein $R^{17}$ and $R^{18}$ may be the same or different and are each hydrogen or a $C_1$- to $C_{10}$-alkyl radical, and $R^{10}$ and $R^{11}$ or $R^{11}$ and $R^{12}$ or $R^{12}$ and $R^{13}$ may also form a second tetrahydrooxazine ring with the —O—$CH_2$—$NR^{15}$—$CH_2$— substructure attached to the benzene ring, or $R^{10}$ and $R^{11}$ and $R^{12}$ and $R^{13}$ may also form a second and a third tetrahydrooxazine ring with the —O—$CH_2$—$NR^{15}$—$CH_2$— and —O—$CH_2$—$NR^{16}$—$CH_2$— substructures attached to the benzene ring, $R^{15}$ and $R^{16}$ are each independently hydrocarbyl radicals comprising in each case from 1 to 3000 carbon atoms and may be interrupted by one or more heteroatoms from the group of O and S and/or by one or more $NR^{14}$ moieties, with the proviso that at least one of $R^9$, $R^{10}$, $R^{11}$, $R^{12}$, $R^{13}$, $R^{15}$, and $R^{16}$ comprises from 4 to 3000 carbon atoms and the remaining substituents from the group of $R^9$, $R^{10}$, $R^{11}$, $R^{12}$, $R^{13}$, $R^{15}$ and $R^{16}$, when they are hydrocarbyl radicals, each comprise from 1 to 20 carbon atoms;

and (A2) a polycyclic phenolic compound comprising up to 20 benzene rings per molecule, obtained by reacting (a2-i) a tetrahydrobenzoxazine of formula (XXVI)

(XXVI)

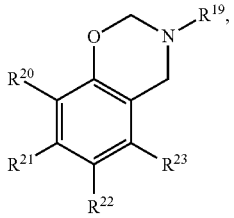

wherein substituent $R^{19}$ is a hydrocarbyl radical comprising from 1 to 3000 carbon atoms and may be interrupted by one or more heteroatoms from the group of O and S and/or by one or more $NR^{24}$ moieties, $R^{24}$ is a hydrogen atom or a $C_1$- to $C_4$-alkyl radical, and $R^{20}$, $R^{21}$, $R^{22}$ and $R^{23}$ are each independently hydrogen atoms, hydroxyl groups, or hydrocarbyl radicals comprising in each case from 1 to 3000 carbon atoms and may be interrupted by one or more heteroatoms from the group of O and S and/or by one or more $NR^{24}$ moieties, with at least one of (a2-ii) one or more of the same or different phenols of formula (XXVII)

(XXVII)

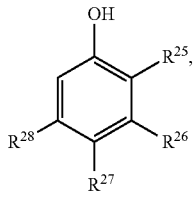

wherein $R^{25}$, $R^{26}$, $R^{27}$, and $R^{28}$, are each independently hydrogen atoms groups, or hydrocarbyl radicals comprising in each case from 1 to 3000 carbon atoms and may be interrupted by one or more heteroatoms from the group of O and S and/or by one or more $NR^{24}$ moieties, and (a2-iii) one or more of the same or different tetrahydrobenzoxazines of formula (XXVI) wherein $R^{22}$ may also be a radical of the formula (Z") and $R^{27}$ may also be a radical of the formula (Z'")

(Z")

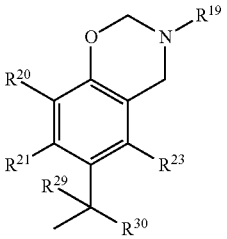

(Z'")

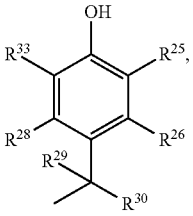

wherein $R^{25}$ may also be a radical derived from a tetrahydrobenzoxazine of formula (XXVI), $R^{33}$ is hydrogen or a radical derived from a tetrahydrobenzoxazine of formula (XXVI), and $R^{29}$ and $R^{30}$ may be the same or different and are each hydrogen or a $C_1$- to $C_{10}$-alkyl radical, and $R^{20}$ and $R^{21}$ or $R^{21}$ and $R^{22}$ or $R^{22}$ and $R^{23}$ may also form a second tetrahydrooxazine ring with the —O—$CH_2$—$NR^{31}$—$CH_2$— substructure attached to the benzene ring, or $R^{20}$ and $R^{21}$ and $R^{22}$ and $R^{23}$ may also form a second and a third tetrahydrooxazine ring with the —O—$CH_2$—$NR^{31}$—$CH_2$— and —O—$CH_2$—$NR^{32}$—$CH_2$— substructures attached to the benzene ring, where $R^{31}$ and $R^{32}$ are each independently hydrocarbyl radicals comprising in each case from 1 to 3000 carbon atoms and may be interrupted by one or more heteroatoms from the group of O and S and/or by one or more $NR^{24}$ moieties, with the proviso that at least one of $R^{19}$, $R_{20}$, $R_{21}$, $R^{22}$, $R^{23}$, $R^{25}$, $R^{26}$, $R^{27}$, $R^{28}$, $R^{31}$, and $R^{32}$ comprises from 13 to 3000 carbon atoms and the remaining substituents from the group of $R^{19}$, $R^{20}$, $R^{21}$, $R^{22}$, $R^{23}$, $R^{25}$, $R^{26}$, $R^{27}$, $R^{28}$, $R^{31}$, and $R^{32}$, when they are hydrocarbyl radicals, comprise in each case from 1 to 20 carbon atoms; and (B) from 5 to 50 % by weight of at least one of tetrakis [methylene-2 -($C_4$- to $C_{30}$ -alkylthio)propionate]methane, and a $C_4$- to $C_{30}$-alkylthiopropylamide, where a sum of the two components (A) and (B) adds up to 100% by weight.

2. The mixture of claim 1, comprising (A1).

3. The mixture of claim 1, comprising (A2).

4. A method for stabilizing an inanimate organic material against the action at least one of light, oxygen, and heat, the method comprising:

combining the inanimate organic material with the mixture of claim 1.

5. A mineral oil product or fuel, comprising the mixture of claim 1.

6. A turbine or jet fuel, comprising the mixture of claim 1.

7. A method of improving thermal stability of a turbine fuel, the method comprising combining the fuel with a stabilizer comprising the mixture of claim 1.

8. A method of reducing deposits in a fuel system or combustion system of a turbine, the method combusting a fuel comprising the mixture claim 1.

9. An inanimate organic material, comprising the mixture of claim 1.

10. A fuel composition, comprising:

a fuel; and the mixture of claim 1.

11. The composition of claim 10, wherein the fuel is a turbine or jet fuel.

12. An additive concentrate, comprising the mixture of claim 1 and at least one of a further diluent and a further additive.

13. A method for improving at least one of oxidation, aging, and shear stability of a lubricant composition, the method comprising:

combining the lubricant composition with the mixture of claim 1.

14. A lubricant composition, comprising the mixture of claim 1.

15. The mixture of claim 1, wherein $R^{12}$ is a radical of formula (Y), and X is a hydrocarbon bridging member which consists of one or more isobutene units.

16. The composition of claim 10, wherein a concentration of the mixture in the composition, relative to a total weight of organic components, is 0.0001 to 5 wt. %.

17. The mixture of claim 1, wherein (A) is present in an amount of 65 to 95% by weight, and (B) is present in an amount of 10 to 35% by weight.

* * * * *